US008406086B2

(12) United States Patent
Shimizu et al.

(10) Patent No.: US 8,406,086 B2
(45) Date of Patent: Mar. 26, 2013

(54) ELECTRONIC TIMEPIECE

(75) Inventors: Hiroshi Shimizu, Chiba (JP); Tomohiro Ihashi, Chiba (JP); Kenji Ogasawara, Chiba (JP); Kazuo Kato, Chiba (JP); Kazumi Sakumoto, Chiba (JP); Akira Takakura, Chiba (JP); Eriko Noguchi, Chiba (JP); Takanori Hasegawa, Chiba (JP); Keishi Honmura, Chiba (JP); Saburo Manaka, Chiba (JP); Kosuke Yamamoto, Chiba (JP)

(73) Assignee: Seiko Instruments Inc. (JP)

( * ) Notice: Subject to any disclaimer, the term of this patent is extended or adjusted under 35 U.S.C. 154(b) by 206 days.

(21) Appl. No.: 12/932,126

(22) Filed: Feb. 17, 2011

(65) Prior Publication Data

US 2011/0216630 A1 Sep. 8, 2011

(30) Foreign Application Priority Data

Mar. 2, 2010 (JP) ..... 2010-045885
Mar. 25, 2010 (JP) ..... 2010-071071
Jan. 11, 2011 (JP) ..... 2011-003407

(51) Int. Cl.
*G04C 17/00* (2006.01)
*G04B 19/04* (2006.01)
*G04F 8/00* (2006.01)

(52) U.S. Cl. ..... 368/69; 368/80; 368/110; 368/224

(58) Field of Classification Search ..... 368/69, 368/72, 73, 80, 107, 110, 204, 223, 224, 368/228
See application file for complete search history.

(56) References Cited

U.S. PATENT DOCUMENTS 4,253,172 A * 2/1981 Nomura ..... 368/72
4,358,840 A * 11/1982 Ono et al. ..... 368/251
4,470,707 A * 9/1984 Chambon et al. ..... 368/74
5,379,281 A * 1/1995 Koch ..... 368/72
6,975,562 B2 * 12/2005 Lizzi ..... 368/69

OTHER PUBLICATIONS

Abstract, publication No. JP5196754, publication date Aug. 6, 1993.

* cited by examiner

*Primary Examiner* — Vit W Miska
(74) *Attorney, Agent, or Firm* — Adams & Wilks

(57) ABSTRACT

An electronic timepiece can reduce a burden imposed on a user who performs a manipulation for correcting the positional displacement of a pointer when a position of the pointer is displaced due to the demonstration of the pointer movement. The electronic timepiece includes: a pointer which is rotated in a first direction based on a manipulation signal corresponding to a manipulation from the outside; and a control part which performs the demonstration of the pointer movement in which the pointer is rotated in a second direction opposite to the first direction and the first direction, wherein the pointer is positioned at a position where a rotational angle in the first direction from a preset reference position is smaller than a rotational angle in a second direction from the reference position.

12 Claims, 12 Drawing Sheets

| | CROWN POSITIONED AT ZERO STAGE | CROWN POSITIONED AT FIRST STAGE |
|---|---|---|
| FUNCTION OF SWITCH A | START/STOP CHRONOGRAPH | CORRECT 1/10 SECOND HAND IN CHRONOGRAPH |
| FUNCTION OF SWITCH B | RESET CHRONOGRAPH | CORRECT 1 SECOND HAND IN CHRONOGRAPH |
| SWITCHES A+B (SWITCHES BEING PUSHED SIMULTANEOUSLY) | PERFORM NO FUNCTION | PERFORM DEMONSTRATION OF POINTER MOVEMENT |
| FUNCTION OF CROWN | PERFORM NO FUNCTION | CORRECT TIME |

FIG. 1

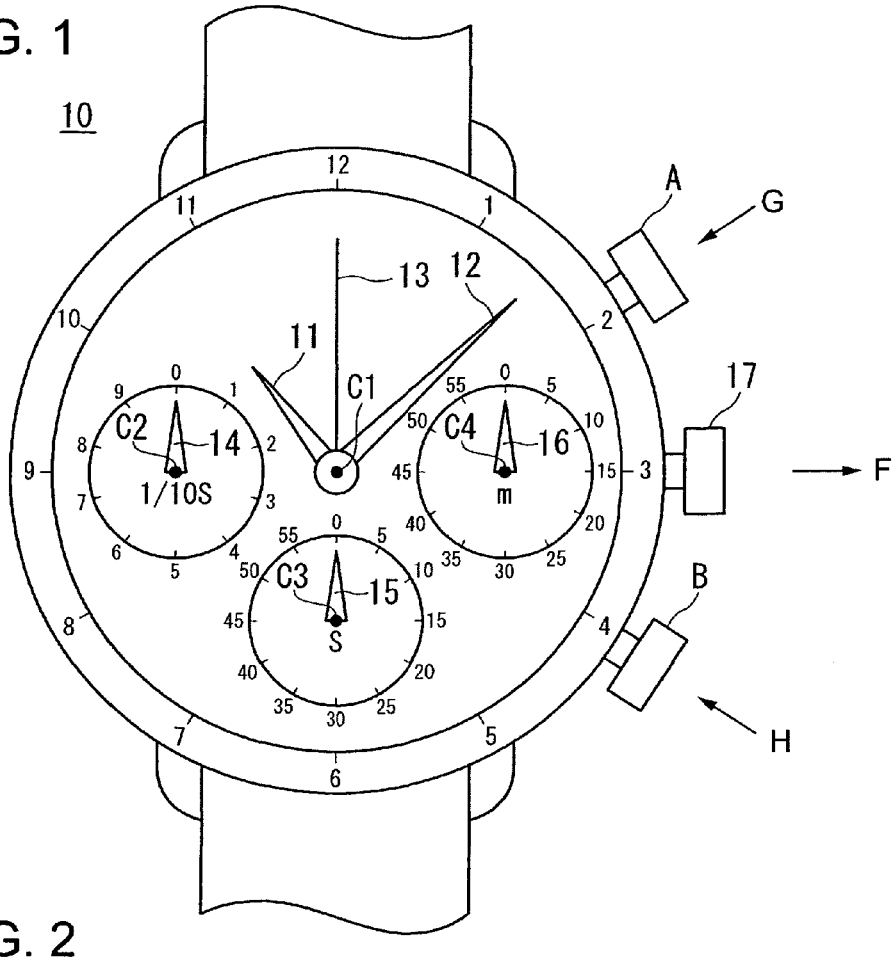

FIG. 2

| | CROWN POSITIONED AT ZERO STAGE | CROWN POSITIONED AT FIRST STAGE |
|---|---|---|
| FUNCTION OF SWITCH A | START/STOP CHRONOGRAPH | CORRECT 1/10 SECOND HAND IN CHRONOGRAPH |
| FUNCTION OF SWITCH B | RESET CHRONOGRAPH | CORRECT 1 SECOND HAND IN CHRONOGRAPH |
| SWITCHES A+B (SWITCHES BEING PUSHED SIMULTANEOUSLY) | PERFORM NO FUNCTION | PERFORM DEMONSTRATION OF POINTER MOVEMENT |
| FUNCTION OF CROWN | PERFORM NO FUNCTION | CORRECT TIME |

| | |
|---|---|
| STORAGE PART FOR STORING THE NUMBER OF TIMES OF FORWARD ROTATION IN DEMONSTRATION OF POINTER MOVEMENT | 29 |
| STORAGE PART FOR STORING THE NUMBER OF TIMES OF BACKWARD ROTATION IN DEMONSTRATION OF POINTER MOVEMENT | 30 |

FIG. 7

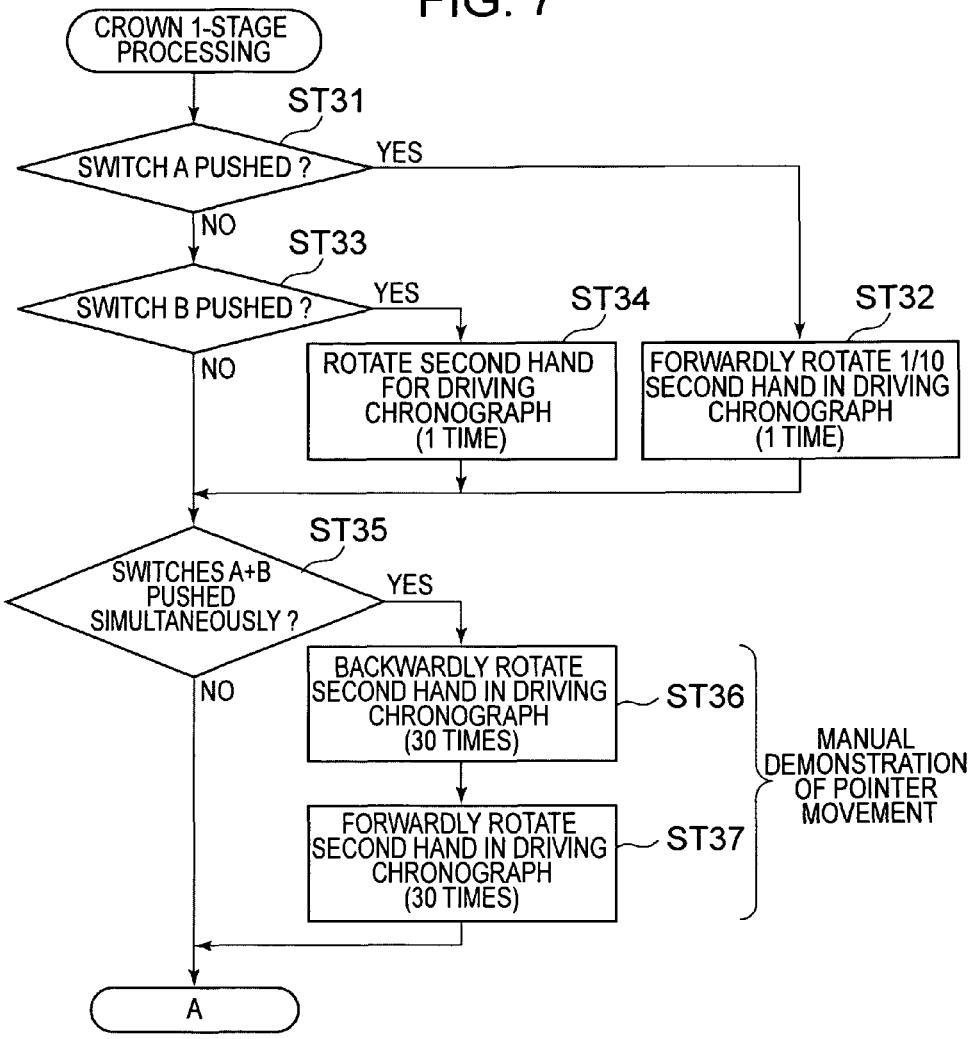

FIG. 8

| | CROWN POSITIONED AT ZERO STAGE | CROWN POSITIONED AT FIRST STAGE | DEMONSTRATION OF POINTER MOVEMENT |
|---|---|---|---|
| FUNCTION OF SWITCH A | START / STOP CHRONOGRAPH | CORRECT CHRONOGRAPH 1/10 SECOND HAND | INTERRUPT DEMONSTRATION OF POINTER MOVEMENT |
| FUNCTION OF SWITCH B | RESET CHRONOGRAPH | CORRECT SECOND HAND IN CHRONOGRAPH | INTERRUPT DEMONSTRATION OF POINTER MOVEMENT |
| FUNCTION OF CROWN | PERFORM NO FUNCTION | CORRECT TIME | — |

CONSTITUTIONAL EXAMPLE OF ELECTRONIC TIMEPIECE

MOTOR ROTATED DUE TO REPULSIVE POLARITY

MOTOR NOT ROTATED DUE TO ATTRACTIVE POLARITY

ELECTRONIC TIMEPIECE

BACKGROUND OF THE INVENTION

1. Field of the Invention

The present invention relates to an electronic timepiece which performs the demonstration of the pointer movement in which a pointer is moved on a test basis.

2. Background Art

For example, there has been known an electronic timepiece in which a user can move a pointer of a timepiece is by rotating a crown in a state where the crown is pulled up thus adjusting time or correcting the positional displacement of the pointer (see JP-A-5-196754 (patent document 1), for example).

This electronic timepiece performs the demonstration of the pointer movement in which when a user pushes the crown in a pulled-up state, when the crown is returned to a normal state where the electronic timepiece exhibits the timing function from a correction state for correcting the pointer, the pointer is rotated by a fixed amount and, thereafter, the pointer is reversely rotated to an original position.

However, in the demonstration of the pointer movement, when the pointer is not rotated in accordance with a control part which controls a rotational amount of the pointer, there may be a case where the pointer does not return to an original position after the demonstration of the pointer movement. When the pointer does not return to the original position in this manner, it is necessary for the user to push a manipulation button so as to return the pointer whose position is displaced to the original position. Here, with respect to the manipulation button, to consider a case where there is only the manipulation button which performs the forward movement of the pointer in the clockwise direction and there is no manipulation button which performs the backward movement of the pointer in the counterclockwise direction, when the pointer is displaced in the clockwise direction only by 1 scale in the demonstration of the pointer movement, there arises a drawback that a pointer returning operation using only the forward pointer movement imposes a large burden on a manipulation by the user.

Hereinafter, the explanation is made in detail by taking, for example, as shown in FIG. 15A and FIG. 15B, an electronic timepiece where as a rotary shaft of a motor which gives power to a pointer, a rotary shaft M having a circular columnar shape which has one half columnar portion thereof formed of an N pole and another half columnar portion thereof formed of an S pole is subject to electromagnetic induction so that the pointer movement is generated as an example.

In the demonstration of the pointer movement, when the forward pointer movement is performed by 30-scale pointer movement (1-scale pointer movement meaning the rotation of the rotary shaft which moves the pointer by 1 scale, the same definition being applicable hereinafter), when a stop state of the rotary shaft M (that is, a motor drive polarity indicative of the relationship between the polarity of the rotary shaft M and the polarity generated by electromagnetic induction) is not recognized in advance, with the first 1-scale pointer movement in the backward pointer movement, the motor drive polarity is brought into an attractive state. Accordingly, the pointer is rotated in the counterclockwise direction by 29 scales due to the backward pointer movement and is rotated in the clockwise direction by 30 scales due to the forward pointer movement thus giving rise to a drawback that the pointer does not return to the original position.

To be more specific, as shown in FIG. 15A and FIG. 15B, a coil C is wound around a rotary shaft supporting member K which rotatably supports the rotary shaft M, and a magnetic field is generated in the rotary shaft supporting member K when an electric current is supplied to the coil C. Since the polarity of the magnetic field generated in the rotary shaft supporting member K and the polarity of the rotary shaft M repel each other, the rotary shaft M is rotated and power is imparted to a pointer.

When an electric current I which flows in the direction P is supplied to the coil C in a state where an S-pole magnet of the rotary shaft M is on an L side of the rotary shaft M and an N-pole magnet of the rotary shaft M is on an R side of the rotary shaft M as shown in FIG. 15A, the motor drive polarity becomes the repulsive polarity so that the rotary shaft M is rotated.

On the other hand, when an electric current I which flows in the direction P is supplied to the coil C in a state where the N-pole magnet of the rotary shaft M is on the L side of the rotary shaft M and the S-pole magnet of the rotary shaft M is on the R side of the rotary shaft M as shown in FIG. 15B, the motor drive polarity becomes the attractive polarity so that the rotary shaft M is not rotated. In this case, by supplying an electric current I which flows in the direction Q to the coil C, the motor drive polarity becomes the repellant polarity so that the rotary shaft M is rotated.

For example, when the demonstration of the pointer movement is performed after a battery is exchanged, a control part which supplies the electric current I to the coil C does not recognize a state of polarities of the magnets which constitute the rotary shaft M. Accordingly, the motor drive polarity becomes the attractive polarity so that the rotary shaft M of the motor is not rotated in the first pointer movement, is rotated in the counterclockwise direction by an amount of 29 scales due to the backward pointer movement, and is rotated in the clockwise direction by an amount of 30 scales due to the forward pointer movement. Accordingly, in the demonstration of the pointer movement, the pointer is displaced in the clockwise direction by 1 scale.

Accordingly, in returning a second hand whose 1 cycle is constituted of 60 scales to an original position, it is necessary to return the second hand to the original position by pushing a button 59 times.

Further, in the case where a minute hand is connected to the second hand by means of a gear train, one rotation of the second hand in the clockwise direction makes the minute hand advance by 1 scale. Accordingly, to adjust the positional displacement of both of the second hand and the minute hand, it is necessary to push the button 3599 times.

Accordingly, there arises a drawback that an extremely large burden is imposed on a user who performs a manipulation to correct the positional displacement of a pointer caused by the demonstration of the pointer movement.

SUMMARY OF THE INVENTION

It is an aspect of the present application to provide an electronic timepiece which can reduce a burden imposed on a user who performs a manipulation for correcting the positional displacement of a pointer when a position of a pointer is displaced by the demonstration of the pointer movement.

According to another aspect of the present application, there is provided an electronic timepiece which includes: a pointer which is rotated in the first direction based on a manipulation signal corresponding to a manipulation from the outside; and a control part which performs the demonstration of the pointer movement in which the pointer is rotated in the second direction opposite to the first direction and the first direction, wherein the pointer is positioned at a position where a rotational angle in the first direction from a preset reference position is smaller than a rotational angle in the second direction from the reference position.

In one mode of the electronic timepiece having the above-mentioned constitution, the control part, in the demonstration of the pointer movement, sets a rotational angle by which the pointer is rotated in the first direction after the pointer is rotated in the second direction from the reference position smaller than a rotational angle by which the pointer is rotated in the second direction.

In another mode of the electronic timepiece having the above-mentioned constitution, the control part, in the demonstration of the pointer movement, sets the number of times that the pointer is moved in the first direction after the pointer is rotated in the second direction from the reference position is set smaller than the number of times that the pointer is moved in the second direction.

In another mode of the electronic timepiece having the above-mentioned constitution, the control part, in the demonstration of the pointer movement, sets a rotational angle by which the pointer is rotated in the second direction after the pointer is rotated in the first direction from the reference position is set larger than a rotational angle by which the pointer is rotated in the first direction.

In another mode of the electronic timepiece having the above-mentioned constitution, the control part, in the demonstration of pointer movement, sets the number of times that the pointer is moved in the second direction after the pointer is rotated in the first direction from the reference position is set larger than the number of times that the pointer is moved in the first direction.

In another mode of the electronic timepiece having the above-mentioned constitution, the control part sets the number of times that the pointer is rotated in the first direction is set smaller than the number of times that the pointer is rotated in the second direction.

In another mode of the electronic timepiece having the above-mentioned constitution, the control part performs the demonstration of the pointer movement in which the rotational direction of the pointer is reversed two times or more by combining the rotation in the first direction and the rotation in the second direction.

In another mode of the electronic timepiece having the above-mentioned constitution, the control part, in the demonstration of pointer movement, counts a first count number which is the number of times that the pointer is rotated in the first direction and a second count number which is the number of times that the pointer is rotated in the second direction, and finishes the demonstration of the pointer movement when the number of times obtained by subtracting the first count number from the second count number is 1 or more.

In another mode of the electronic timepiece having the above-mentioned constitution, the control part reverses the rotational direction of the pointer when a second manipulation signal which differs from the first manipulation signal is inputted to the control part from the outside in the demonstration of the pointer movement.

In another mode of the electronic timepiece having the above-mentioned constitution, the control part stops the pointer in a rotating state when a second manipulation signal which differs from the first manipulation signal is inputted to the control part in the demonstration of the pointer movement.

In another mode of the electronic timepiece having the above-mentioned constitution, the control part determines whether or not the supply of electricity from a battery is started in a state where the supply of electricity from the battery is interrupted, and starts the demonstration of the pointer movement when the control part determines that the supply of electricity from the battery is started.

In another mode of the electronic timepiece having the above-mentioned constitution, the pointer is a pointer which measures a lapsed time when a stopwatch function installed in the electronic timepiece is carried out.

When the position of the pointer is displaced in the demonstration of the pointer movement, it is possible to reduce a burden imposed on a user when the user corrects the positional displacement of the pointer.

BRIEF DESCRIPTION OF THE DRAWINGS

FIG. 1 is a schematic view showing one example of an electronic timepiece according to a first embodiment of the present invention;

FIG. 2 is a view for explaining one example of a function of the electronic timepiece according to the first embodiment of the present invention;

FIG. 7 is a flowchart for explaining one example of an operation flow of processing of the electronic timepiece according to the first embodiment of the present invention when a crown is positioned at a first stage;

FIG. 8 is a view for explaining one example of a function of the timepiece according to a second embodiment of the present invention;

DESCRIPTION OF THE PREFERRED EMBODIMENT

First Embodiment

Figure 3:
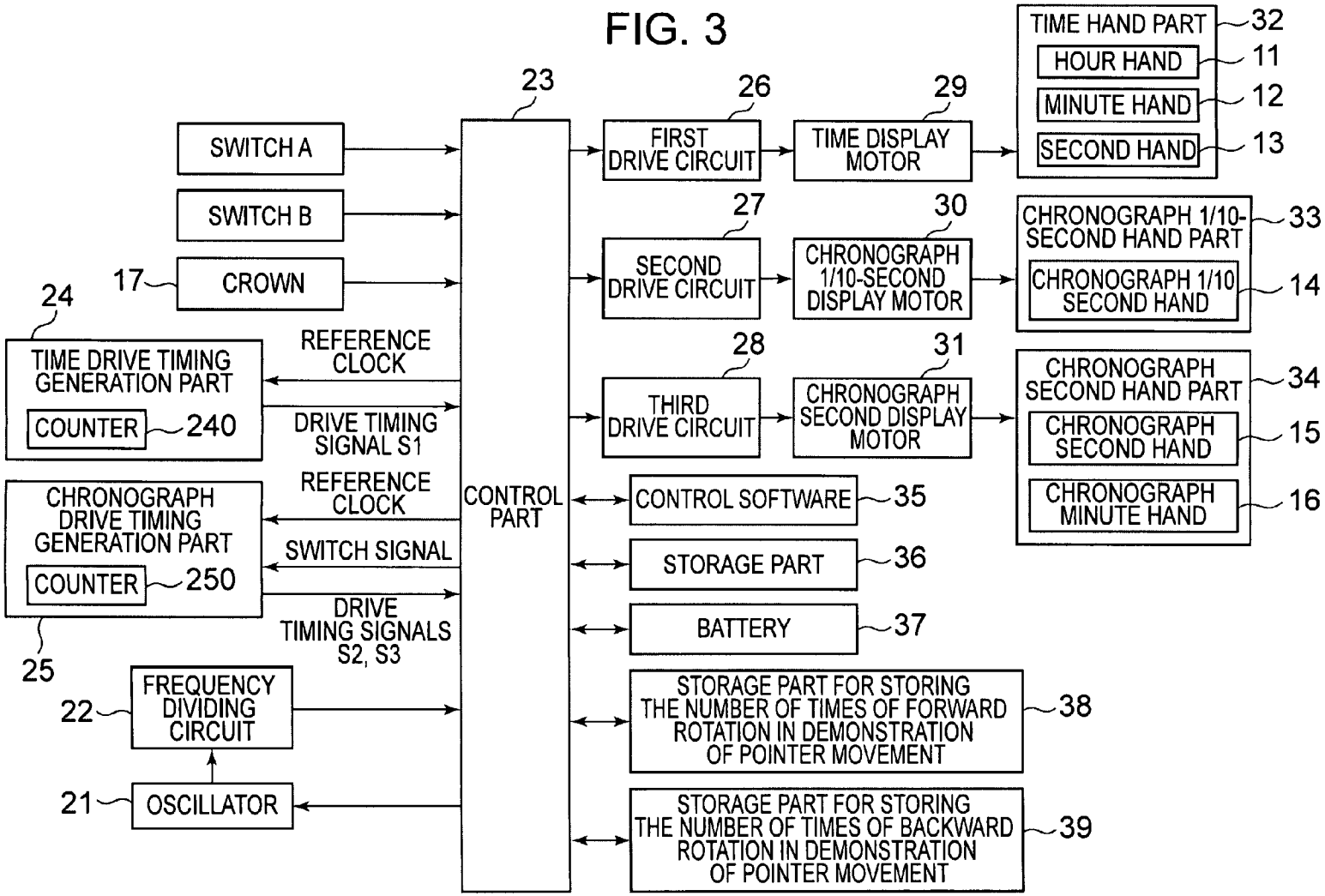
FIG. 3 is a block diagram for explaining one example of a control system of the electronic timepiece according to the first embodiment of the present invention.

Hereinafter, one embodiment of the present invention is explained in conjunction with drawings.

FIG. 1 is a schematic view showing one example of an electronic timepiece 10 according to this embodiment.

As shown in FIG. 1, the electronic timepiece 10 according to this embodiment includes an hour hand 11, a minute hand 12 and a second hand 13 which are arranged in a rotatable manner about a center axis C1. The electronic timepiece 10 includes a chronograph 1/10 second hand 14 which is arranged in a rotatable manner about a center axis C2 which differs from the center axis C1, a chronograph second hand 15 which is arranged in a rotatable manner about a center axis C3 which differs from the center axis C1, and a chronograph minute hand 16 which is arranged in a rotatable manner about a center axis C4 which differs from the center axis C1.

The hour hand 11, the minute hand 12, and the second hand 13 are pointers for realizing a timepiece function for measuring a time. The chronograph 1/10 second hand 14, the chronograph second hand 15, and the chronograph minute hand 16 are pointers for realizing a stop watch function for measuring a lapsed time.

The hour hand 11, the minute hand 12, and the second hand 13 are connected to each over by a gear train, for example, and are rotated in an interlocking manner respectively with the supply of power from the same motor (indicated by symbol 29 in FIG. 3). That is, when power corresponding to 60 seconds (in other words, an amount of rotation which rotates the second hand 13 by 60 scales where the second hand 13 counts 1 second per 1 scale) is given to the second hand 13 by the motor, the second hand 13 completes one turn and returns to an original place, and the minute hand 12 which follows the movement of the second hand 13 advances 1 scale corresponding to 1 minute. Further, when power corresponding to 3600 seconds is given to the second hand 13 by the motor, the second hand 13 completes 60 turns and returns to an original place, and the minute hand 12 completes 1 turn and returns to an original place, and the hour hand 11 which follows the movement of the second hand 13 advances 5 scales corresponding to 1 hour.

As described above, the structural body which rotates the hour hand 11, the minute hand 12 and the second hand 13 such that the minute hand 12 and the hour hand 11 follow the rotation of the second hand 13 with power given from the motor is referred to as "time hand part" (indicated by symbol 32 in FIG. 3) hereinafter.

Further, the chronograph 1/10 second hand 14 is rotated with power by one motor (indicated by symbol 30 in FIG. 3). When a rotational power corresponding to 1/10 seconds is given to the chronograph 1/10 second hand 14, the chronograph 1/10 second hand 14 advances by 1 scale. The advancement of the pointer by 1 scale is also referred to as the rotation of the pointer by an amount corresponding to 1 scale. Further, when the number of scales with which the pointer advances is also referred to as a rotational speed hereinafter. When the chronograph 1/10 second hand 14 advances by 10 scales, the chronograph 1/10 second hand 14 completes one cycle and returns to an original place.

The structural body which rotates the chronograph 1/10 second hand 14 with power given from the motor in this manner is referred to as "chronograph 1/10 second hand part" (indicated by symbol 33 shown in FIG. 3) hereinafter.

Further, the chronograph second hand 15 and the chronograph minute hand 16 are connected with each other by a gear train, for example, and are rotated in an interlocking manner respectively with the supply of power from the same motor (indicated by symbol 31 in FIG. 3). That is, when rotational power corresponding to 60 seconds is given to the chronograph second hand 15 by the motor, the chronograph second hand 15 advances by 60 scales thus completing one turn and returns to an original place, and the chronograph minute hand 16 which follows the movement of the chronograph second-hand 15 advances 1 scale corresponding to 1 minute.

The structural body which rotates the chronograph second hand 15 and the chronograph minute hand 16 such that the chronograph minute hand 16 follows the movement of the chronograph second hand 15 along with the rotation of the chronograph second hand 15 due to power given from the motor is referred to as "chronograph second hand part" (indicated by symbol 34 in FIG. 3) hereinafter.

The electronic timepiece 10 includes a crown 17, a switch A and a switch B at positions where a user can manipulate these parts. Here, in conjunction with FIG. 2, not only these parts but also functions corresponding to manipulations given by way of the crown 17, the switch A and the switch B are explained.

The crown 17 can be drawn in the direction F, wherein a state in which the crown 17 is drawn in the direction F is referred to as a state where the crown is positioned at a first stage, and a state in which the crown 17 is pushed in the direction opposite to the direction F is referred to as a state where the crown is positioned at a zero stage.

As shown in FIG. 2, in a state where the crown is positioned at a zero stage, the electronic timepiece 10 starts a stopwatch function obtained by the chronograph 1/10 second hand 14, the chronograph second hand 15 and the chronograph minute hand 16 when the switch A is pushed in the direction G (chronograph start) or stops the stopwatch function (chronograph stop).

For example, when the electronic timepiece 10 is in a state where the crown is positioned at a zero stage so that the chronograph 1/10 second hand 14, the chronograph second hand 15 and the chronograph minute hand 16 are stopped, when the switch A is pushed in the direction G, the electronic timepiece 10 starts the chronograph 1/10 second hand 14 operation, the chronograph second hand 15 operation and the chronograph minute hand 16 operation respectively. On the other hand, when the electronic timepiece 10 is in a state where the crown is positioned at a zero stage so that the chronograph 1/10 second hand 14, the chronograph second hand 15 and the chronograph minute hand 16 are being operated, by pushing the switch A in the direction G, a user can stop the chronograph 1/10 second hand 14 operation, the chronograph secondhand 15 operation and the chronograph minute hand 16 operation.

When the electronic timepiece 10 is in a state where the crown is positioned at a zero stage, by pushing the switch B in the direction H, the chronograph 1/10 second hand 14 operation, the chronograph second hand 15 operation and the chronograph minute hand 16 operation are reset, that is, are returned to an original state (return to zero).

This "resetting of operation" means that the chronograph 1/10 second hand 14, the chronograph second hand 15 and the chronograph minute hand 16 are forcibly returned to a preset reference position (return to zero) and also means that the pointer movement of the chronograph 1/10 second hand 14, the chronograph second hand 15 and the chronograph minute hand 16 is stopped and electric positional information is reset.

The reference positions of the chronograph 1/10 second hand 14, the chronograph second hand 15 and the chronograph minute hand 16 mean that the respective hands are at a position of "zero" respectively as shown in the drawings.

In a state where the crown is positioned at a zero stage, even when both the switch A and the switch B are pushed simultaneously or the crown 17 is rotated, the electronic timepiece 10 performs no function.

On the other hand, when the electronic timepiece 10 is in a state where the crown is positioned at a first stage, by pushing the switch A in the direction G one time, the chronograph 1/10 second hand 14 is rotated in the clockwise direction by scale. That is, in the electronic timepiece 10, the chronograph 1/10 second hand 14 is rotated in the clockwise direction one time in response to a manipulation signal. Accordingly, a user can correct the positional displacement of the chronograph 1/10 second hand 14.

Further, when the electronic timepiece 10 is in a state where the crown is positioned at a first stage, by pushing the switch B one time in the direction H, the chronograph second hand 15 is rotated in the clockwise direction only by 1 scale. That is, in the electronic timepiece 10, the chronograph second hand 15 is rotated in the clockwise direction one time in response to the manipulation signal. Accordingly, the user can correct the positional displacement of the chronograph second hand 15 and the chronograph minute hand 16. That is, the chronograph minute hand 16 follows the movement of the chronograph second hand 15 and hence, in a state where the electronic timepiece 10 is in a state where the crown is positioned at a first stage, by pushing the switch B in the direction H 60 times, the chronograph minute hand 16 can be rotated in the clockwise direction by 1 scale.

Further, in the electronic timepiece 10, by pushing the switch A and the switch B simultaneously in a state where the crown is positioned at a first stage, the electronic timepiece 10 performs the demonstration of the pointer movement in which the chronograph 1/10 secondhand 14, the chronograph secondhand 15 and the chronograph minute hand 16 are operated on a test basis. By performing such demonstration of the pointer movement, the user can confirm whether or not the chronograph second hand 15 and the chronograph minute hand 16 are movable.

Further, in the electronic timepiece 10, when a user rotates the crown 17 in a state where the crown is positioned at a first stage, the hour hand 11, the minute hand 12 and the second hand 13 are rotated in the clockwise direction or the counterclockwise direction. Accordingly, the user can adjust a time.

Next, the control system of the electronic timepiece 10 is explained in conjunction with FIG. 3. FIG. 3 is a block diagram showing controllability of the electronic timepiece 10.

As shown in FIG. 3, the electronic timepiece 10 includes an oscillator 21, a frequency dividing circuit 22, a control part 23, a time drive timing generation part 24, a chronograph drive timing generation part 25, a first drive circuit 26, a second drive circuit 27, a third drive circuit 28, a time display motor 29, a chronograph 1/10 second display motor 30, a chronograph second display motor 31, a time hand part 32, a chronograph 1/10 second hand part 33, a chronograph secondhand part 34, a control software 35, a storage part 36, a battery 37, a storage part 38 for storing the number of times of forward rotation in the demonstration of the pointer movement, and a storage part 39 for storing the number of times of backward rotation in the demonstration of the pointer movement.

The oscillator 21 outputs a reference clock signal at fixed intervals periodically and continuously.

The frequency dividing circuit 22 divides a reference clock signal inputted from the oscillator 21 and outputs the divided reference clock signals to the control part 23.

The control part 23 outputs the reference clock signals inputted from the frequency dividing circuit 22 to the time drive timing generation part 24 and the chronograph drive timing generation part 25. The control part 23 also drives the first drive circuit 26, the second drive circuit 27 and the third drive circuit 28 in accordance with drive timings inputted from the time drive timing generation part 24 and the chronograph drive timing generation part 25 respectively.

Further, the control part 23 detects that the electronic timepiece 10 is in a state where the crown is positioned at a zero stage when the crown 17 is pushed, and executes the crown zero-stage processing by reference to a program stored in the control software 35. Further, the control part 23 detects that the electronic timepiece 10 is in a state where the crown is positioned at a first stage when the crown 17 is drawn, and executes crown first-stage processing. Here, the crown zero-stage processing is processing which is executed in a normal mode in which the electronic timepiece 10 exhibits a timepiece function, and the crown first-stage processing is processing which is executed in a correction mode for correcting the pointers.

Further, the control part 23 is operated in accordance with a program stored in the control software 35 so as to perform the demonstration of the pointer movement at preset timing.

The demonstration of the pointer movement is, for example, constituted of the automatic demonstration of the pointer movement in which the control part 23 performs the demonstration of the pointer movement immediately after electricity is supplied, and the manual demonstration of the pointer movement in which the control part 23 performs the demonstration of the pointer movement in response to manipulation signals outputted from the switch A and the switch B.

This automatic demonstration of the pointer movement operates the chronograph 1/10 second hand 14, the chronograph second hand 15 and the chronograph minute hand 16 immediately after electricity is supplied thus having a function of informing a user of a fact that electricity is normally supplied from an exchanged battery 37 and a fact that the chronograph 1/10 second hand 14, the chronograph second hand 15 and the chronograph minute hand 16 are movable with the supply of electricity.

Further, the manual demonstration of the pointer movement has a function which allows a user to operate the chronograph 1/10 second hand 14, the chronograph second hand 15 and the chronograph minute hand 16 on a test basis after a motor drive polarity is detected by the control part 23.

The control part 23 determines whether or not the supply of electricity from the battery 37 is started in a state where the supply of electricity from the battery 37 is stopped, and the control part 23 starts the automatic demonstration of the pointer movement when the control part 23 determines that the supply of electricity from the battery 37 is started.

The time drive timing generation part 24 and the chronograph drive timing generation part 25 include a counter 240 and a counter 250 which count inputted reference clock signals respectively.

When the time drive timing generation part 24 counts the preset number of inputted reference clock signals, the time drive timing generation part 24 outputs a drive timing signal S1. The counter 240 counts the number of times that the drive timing signal S1 is outputted from the time drive timing generation part 24.

On the other hand, when the chronograph drive timing generation part 25 counts the preset number of inputted reference clock signals, the chronograph drive timing generation part 25 outputs a drive timing signal S2 and a drive timing signal S3. The counter 250 counts the number of times that the drive timing signals S2, S3 are outputted from the chronograph drive timing generation part 25 respectively.

The time drive timing generation part 24 or the chronograph drive timing generation part 25 calculates current positions of the chronograph 1/10 second hand 14, the chronograph second hand 15 and the chronograph minute hand 16 based on the number of times that the counter 240 or the counter 250 counts the drive timing signal S1 or the drive timing signals S2, S3. Here, a value which the counter 240 or the counter 250 counts is stored in the storage part which is incorporated in the time drive timing generation part 24 and the chronograph drive timing generation part 25 respectively.

The time drive timing generation part 24 outputs a drive timing signal S1 each time the number of reference clock signals which indicates a length corresponding to 1 second is counted by the counter 240.

Further, the chronograph drive timing generation part 25 outputs a drive timing signal S2 each time the number of reference clock signals which indicates a length corresponding to 1/10 seconds is counted by the counter 250. The chronograph drive timing generation part 25 outputs a drive timing signal S3 each time the number of reference clock signals which indicates a length corresponding to 1 second is counted by the counter 250. Further, the chronograph drive timing generation part 25 may output a drive timing signal S3 by counting the number of the reference clock signals having a length 10 times as large as a length corresponding to 1/10 seconds, for example.

When a drive timing signal S1 is inputted to the first drive circuit 26 from the time drive timing generation part 24 via the control part 23, the first drive circuit 26 drives a time display motor 29.

When a drive timing signal S2 is inputted to the second drive circuit 27 from the chronograph drive timing generation part 25 via the control part 23, the second drive circuit 27 drives the chronograph 1/10-second display motor 30.

When a drive timing signal S3 is inputted to the third drive circuit 28 from the chronograph drive timing generation part 25 via the control part 23, the third drive circuit 28 drives the chronograph second display motor 31.

These first to third drive circuits 26 to 28 supply an electric current to the coils in response to the respective drive timing signals inputted to the first to third drive circuits 26 to 28 respectively such that drive signals having polarity opposite to polarity in preceding driving are outputted each time the respective motors of the respective drive circuits 26 to 28 are driven.

The time hand part 32 transmits power applied from the time display motor 29 to the hour hand 11, the minute hand 12 and the second hand 13.

The chronograph 1/10-second hand part 33 transmits power applied from the chronograph 1/10-second display motor 30 to the chronograph 1/10 second hand 14.

The chronograph second hand part 34 transmits power applied from the chronograph second display motor 31 to the chronograph second hand 15 and the chronograph minute hand 16.

The control software 35 is a storage area in which a program based on a control by the control part 23 (referred to as a control software program) is stored. In this control software program, for example, it is preset that the control part 23 performs the automatic demonstration of the pointer movement immediately after electricity is supplied. To be more specific, in this control software program, it is preset that, in the automatic demonstration of the pointer movement, the backward pointer movement is performed by an amount corresponding to the number of times of backward rotation in the demonstration of the pointer movement which is stored in the storage part 39 for storing the number of times of backward rotation in the demonstration of the pointer movement and, thereafter, the forward pointer movement is performed by an amount corresponding to the number of times of forward rotation in the demonstration of the pointer movement which is stored in the storage part 38 for storing the number of times of forward rotation in the demonstration of the pointer movement. Here, the number of times of backward rotation in the demonstration of the pointer movement and the number of times of forward rotation in the demonstration of the pointer movement are equal to the number of scales that the pointer advances.

Further, in this control software program, as shown in FIG. 2, a program which defines the control of the control part 23 corresponding to the manipulation is stored.

The storage part 36 temporarily stores a control state brought about by the control part 23 therein. For example, the storage part 36 stores whether or not the stopwatch function using the chronograph 1/10 second hand 14, the chronograph secondhand 15 and the chronograph minute hand 16 (hereinafter, expressed as "in the middle of the chronograph operation) is being performed.

The battery 37 supplies electricity to the whole electronic timepiece 10 via the control part 23.

The storage part 38 for storing the number of times of forward rotation in the demonstration of the pointer movement stores, in the automatic demonstration of the pointer movement, in response to an instruction from the control part 23, the numbers of times of forward rotation in the demonstration of the pointer movement which are constituted of the number of times (scales) of rotation of the chronograph 1/10 second hand 14 in the clockwise direction, the number of times (scales) of rotation of the chronograph second hand 15 in the clockwise direction and the number of times (scales) of rotation of the chronograph minute hand 16 in the clockwise direction. The storage part 38 for storing the number of times of forward rotation in the demonstration of the pointer movement stores 29 scales (29 pointer movements) as the number of times of forward rotation in the demonstration of the pointer movement of the chronograph second hand 15. Here, for example, the storage part 38 stores 4 scales (4 pointer movements) as the number of times of forward rotation in the demonstration of the pointer movement of the chronograph 1/10 second hand 14.

The storage part 39 for storing the number of times of backward rotation in the demonstration of the pointer movement stores, in the automatic demonstration of the pointer movement, in response to an instruction from the control part 23, the numbers of times of backward rotation in the demonstration of the pointer movement which are constituted of the number of times (scales) of rotation of the chronograph 1/10 second hand 14 in the counterclockwise direction, the number of times (scales) of rotation of the chronograph second hand 15 in the counterclockwise direction and the number of times (scales) of rotation of the chronograph minute hand 16 in the counterclockwise direction. The storage part 39 for storing the number of times of backward rotation in the demonstration of the pointer movement stores 30 scales (30 pointer movement) as the number of times of backward rotation in the demonstration of the pointer movement of the chronograph secondhand 15. Here, for example, the storage part 39 stores 5 scales (5 pointer movement) as the number of times of backward rotation of the pointer in the demonstration movement of the chronograph 1/10 second hand 14.

Figures 4, 5:
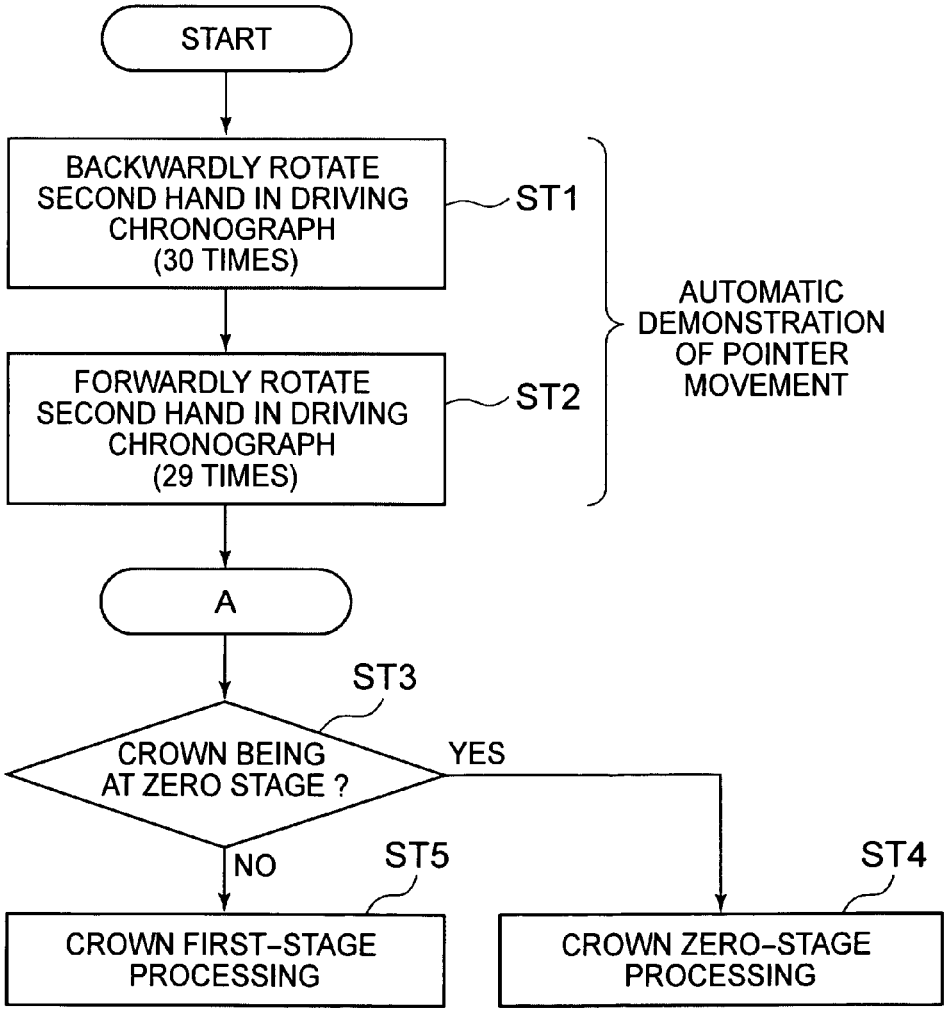
FIG. 4 is a view showing one example of the demonstration of the pointer movement of the electronic timepiece according to the first embodiment of the present invention.
FIG. 5 is a flowchart for explaining one example of an operation flow of the automatic demonstration of the pointer movement of the electronic timepiece according to the first embodiment of the present invention.

FIG. 4 shows the number of times of forward rotation in the demonstration of the pointer movement and the number of times of backward rotation in the demonstration of the pointer movement. As shown in FIG. 4, the numbers of scales that the chronograph 1/10 secondhand 14 and the chronograph secondhand 15 are rotated in the counterclockwise direction (backward rotation) are set smaller than the numbers of scales that the chronograph 1/10 second hand 14, the chronograph second hand 15 and the chronograph minute hand 16 are rotated in the clockwise direction (forward rotation) at least by 1 scale.

In other words, the control part 23 sets angles by which the chronograph 1/10 second hand 14 and the chronograph second hand 15 are rotated in the clockwise direction smaller than angles by which the chronograph 1/10 second hand 14 and the chronograph second hand 15 are rotated in the counterclockwise direction. Here, the above-mentioned setting is limited to a case where the pointers are firstly rotated in the counterclockwise direction in the automatic demonstration of the pointer movement.

That is, in the demonstration of the pointer movement, the control part 23 performs the demonstration of the pointer movement such that the pointers are arranged at positions where rotational angles of the pointers in the clockwise direction from the reference position becomes smaller than rotational angles of the pointers in the counterclockwise direction from the reference position.

Here, as described above, the chronograph 1/10 second hand 14, the chronograph second hand 15 and the chronograph minute hand 16 are rotated only in the clockwise direction in response to a manipulation signal inputted from the control part 23 due to the manipulation of switches A, B, the crown and the like by a user.

In this embodiment, the movements of the pointers in the demonstration of the pointer movement are preset such that the pointers are firstly rotated in the counterclockwise direction and, thereafter, are rotated in the clockwise direction. Here, the "first rotational direction" means the direction that the hands start the rotation thereof even from a state where the pointers are at the reference position.

As described above, in firstly rotating the pointer (for example, the chronograph second hand 15) in the counterclockwise direction, the control part 23 performs the demonstration of the pointer movement such that a rotational angle (corresponding to 29 scales=174°) by which the pointer (the chronograph second hand 15) is rotated in the clockwise direction is set smaller than a rotational angle (corresponding to 30 scales=180°) by which the pointer (the chronograph second hand 15) is rotated in the counterclockwise direction.

Here, in an embodiment where the movements of the pointers in the demonstration of the pointer movement are preset such that the pointers are firstly rotated in the clockwise direction (forward rotation), different from this embodiment, rotational angles of the pointers in the forward rotation and rotational angles of the pointers in the backward rotation may be set equal. That is, the control part 23 performs the demonstration of the pointer movement such that rotational angles by which the pointers are rotated in the counterclockwise direction are set equal to or larger than rotational angles by which the pointers are rotated in the clockwise direction.

In all of the above-mentioned examples, it is premised that the chronograph 1/10 second hand 14, the chronograph second hand 15 and the chronograph minute hand 16 which constitute the pointers which are rotated in the demonstration of the pointer movement are rotated in the clockwise direction based on a manipulation signal in response to the manipulation from the outside.

That is, in an electronic timepiece in which these chronograph 1/10 second hand 14, the chronograph second hand 15 and the chronograph minute hand 16 are rotated in the counterclockwise direction in response to a manipulation signal corresponding to the manipulation from the outside, all of the above-mentioned settings are reversed.

For example, in firstly rotating the pointers in the counterclockwise direction (backward rotation) as the movements of the pointers in the demonstration of the pointer movement, the control part 23 performs the demonstration of the pointer movement such that rotational angles by which the pointers are rotated in the counterclockwise direction are set equal to or smaller than rotational angles by which the pointers are rotated in the clockwise direction.

Further, in firstly rotating the pointers in the clockwise direction (forward rotation) as the movements of the pointers in the demonstration of the pointer movement, the control part 23 performs the demonstration of the pointer movement such that rotational angles by which the pointers are rotated in the clockwise direction are set smaller than rotational angles by which the pointers are rotated in the counterclockwise direction.

Figure 6:
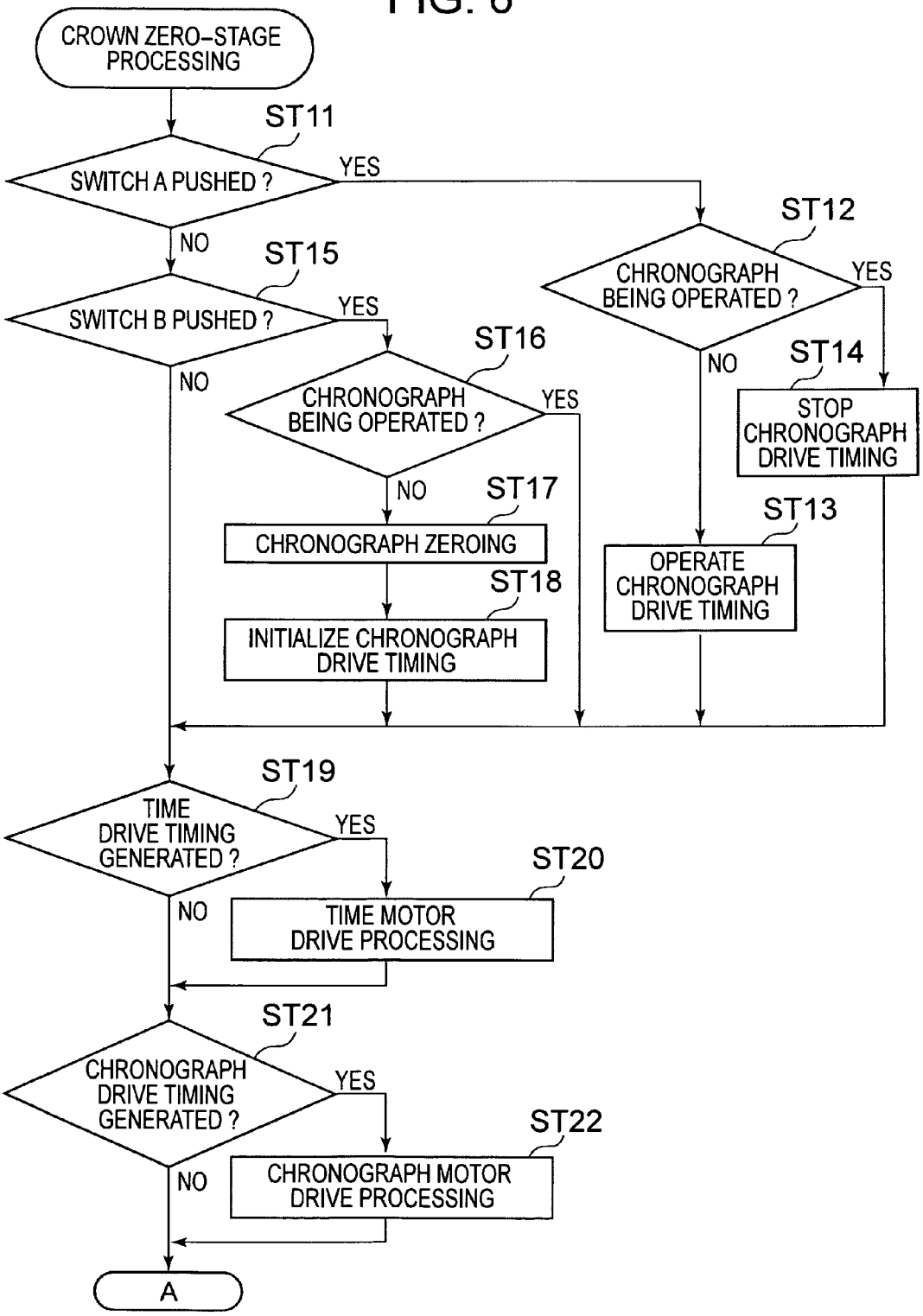
FIG. 6 is a flowchart for explaining one example of an operation flow of processing of the electronic timepiece according to the first embodiment of the present invention when a crown is positioned at a zero stage.

Next, the manner of operation of the electronic timepiece 10 is explained in conjunction with FIG. 5 to FIG. 7. Here, the explanation is made by taking a case where the chronograph second hand 15 is moved in the demonstration of the pointer movement as an example hereinafter. The explanation of the demonstration of the pointer movement of the chronograph 1/10 second hand 14 is omitted.

FIG. 5 is a flowchart for explaining the flow of the automatic demonstration of the pointer movement in the electronic timepiece 10.

As shown in FIG. 5, for example, when a battery is exchanged by a user, electricity of the exchanged battery 37 is supplied to the control part 23. In response to such an operation, the control part 23 determines the supply of electricity by reference to the control software 35, and starts the automatic demonstration of the pointer movement. Further, the control part 23 supplies electricity from the battery 37 to the oscillator 21 and obtains a reference clock signal from the oscillator 21.

The control part 23 moves the chronograph second hand 15 by 30 scales in the counterclockwise direction by reference to the storage part 39 for storing the number of times of backward rotation in the demonstration of the pointer movement (step ST1). Next, the control part 23 moves the chronograph second hand 15 by 29 scales in the clockwise direction by reference to the storage part 38 for storing the number of times of forward rotation in the demonstration of the pointer movement (step ST2).

In this automatic demonstration of the pointer movement, the third drive circuit 28 detects the motor drive polarity of the chronograph second display motor 31 and stores the detected polarity in the storage part incorporated therein. In the same manner, the second drive circuit 27 detects the motor drive polarity of the chronograph 1/10-second display motor 30 and stores the detected polarity in the storage part incorporated therein.

Next, the control part 23 determines whether the crown 17 is in a state where the crown is positioned at a first stage or in a state where the crown is positioned at a zero stage (step ST3).

When the control part 23 determines that the crown 17 is in a state where the crown is positioned at a zero stage (step ST3, YES), the processing advances to crown zero-stage processing (step ST4). On the other hand, when the control part 23 determines that the crown 17 is in a state where the crown is positioned at a first stage (step ST3, NO), the processing advances to crown first-stage processing (step ST5).

Next, one example of the crown zero-stage processing is explained in conjunction with FIG. 6. FIG. 6 is a flowchart for explaining one example of the crown zero-stage processing.

As shown in FIG. 6, when the crown 17 is shifted to a state where the crown is positioned at a zero stage, the control part 23 determines whether or not the switch A is pushed (step ST11). When the control part 23 determines that the switch A is pushed, the control part 23 determines whether or not the electronic timepiece 10 is in the middle of the chronograph operation by reference to the storage part 36 (step ST12).

When the control part 23 determines that the electronic timepiece 10 is not in the middle of the chronograph operation (step ST12, NO), the control part 23 outputs a switch signal indicative of starting of a stopwatch function to the chronograph drive timing generation part 25 thus making the chronograph drive timing generation part 25 start the stopwatch function in accordance with the chronograph (step ST13). The control part 23 also makes the storage part 36 store information which indicates that the electronic timepiece 10 is in the middle of the chronograph operation.

On the other hand, when the control part 23 determines that the electronic timepiece 10 is in the middle of chronograph operation (step ST12, YES), the control part 23 outputs a switch signal which indicates stopping of the stopwatch function to the chronograph drive timing generation part 25 (step ST14). The control part 23 also erases information indicating that the electronic timepiece 10 is in the middle of the chronograph operation which is stored in the storage part 36. The control part 23 may also make the storage part 36 store information indicating that the electronic timepiece 10 is not in the middle of the chronograph operation.

When the control part 23 determines that the switch A is not pushed in step ST11 (step ST11, NO), the control part 23 determines whether or not the switch B is pushed (step ST15). When the control part 23 determines that the switch B is pushed, the control part 23 determines whether or not the electronic timepiece 10 is in the middle of the chronograph operation by reference to the storage part 36 (step ST16).

When the control part 23 determines that the electronic timepiece 10 is not in the middle of the chronograph operation (step ST16, NO), the control part 23 makes the chronograph drive timing generation part 25 return the chronograph 1/10 second hand 14, the chronograph second hand 15 and the chronograph minute hand 16 to an initial state (hereinafter, referred to as "chronograph zeroing") (step ST17). For example, the control part 23 calculates current positions of the chronograph 1/10 second hand 14, the chronograph second hand 15 and the chronograph minute hand 16 based on drive timing signals S2, S3 which are counted by the counter 250 and performs the chronograph zeroing by moving the respective pointers by scales corresponding to the differences between the position of scale "0" which is the reference position of the respective pointers and the current positions of the respective pointers.

Next, the control part 23 performs the initialization by erasing the numbers of counting of drive timing signals S2, S3 and the number of counting based on the number of reference clocks which are stored in a storage part incorporated in the chronograph drive timing generation part 25 (step ST18).

On the other hand, when the control part 23 determines that the electronic timepiece 10 is in the middle of the chronograph operation in step ST16 (step ST16, YES), the processing is shifted to step ST19.

Next, the control part 23 determines whether or not a drive timing signal S1 is inputted to the control part 23 from the time drive timing generation part 24 (step ST19).

When a time which is counted by the counter 240 based on the reference clock signal elapses 1 second, the time drive timing generation part 24 outputs a drive timing signal S1 to the control part 23. When the drive timing signal S1 is inputted to the control part 23, the control part 23 determines that time drive timing is generated (step ST19, YES) and drives the first drive circuit 26 thus moving the second hand 13 by 1 scale (step ST20).

Then, the control part 23 determines whether or not a drive timing signal S2 or a drive timing signal S3 is inputted to the control part 23 from the chronograph drive timing generation part 25 (step ST21).

Here, a time for moving the chronograph 1/10 second hand 14 by 1 scale from a point of time that a switch signal indicative of starting of the operation is inputted is counted by the counter 250 based on a reference clock signal in step ST13, the chronograph drive timing generation part 25 outputs a drive timing signal S2 to the control part 23. When the drive timing signal S2 is inputted to the control part 23, the control part 23 determines that chronograph drive timing is generated (step ST21, YES) and drives the second drive circuit 27 thus moving the chronograph 1/10 second hand 14 by 1 scale (step ST22).

When a time for moving the chronograph second hand 15 by 1 scale from a point of time that a switch signal is inputted to the chronograph drive timing generation part 25 is counted by the counter 250 based on a reference clock signal, the chronograph drive timing generation part 25 outputs a drive timing signal S3 to the control part 23. Due to such an operation, the chronograph second hand 15 is moved by 1 scale.

Then, the processing returns to step A shown in FIG. 5. Next, one example of the crown first-stage processing is explained in conjunction with FIG. 7. FIG. 7 is a flowchart for explaining one example of the crown first-stage processing.

As shown in FIG. 7, when the crown 17 is shifted to a state where the crown is positioned at a first stage, the control part 23 determines whether or not the switch A is pushed (step ST31). When the control part 23 determines that the switch A is pushed, the control part 23 drives the second drive circuit 27. Due to such an operation, the chronograph 1/10-second display motor 30 moves the chronograph 1/10 second hand 14 by 1 scale (step ST32).

When the control part 23 determines that the switch A is not pushed in step ST31 (step ST31, NO), the control part 23 determines whether or not the switch B is pushed (step ST33).

When the control part 23 determines that the switch B is pushed (step ST33, YES), the control part 23 drives the third drive circuit 28. Due to such an operation, the chronograph second display motor 31 moves the chronograph second hand 15 by 1 scale (step ST34).

Next, when the control part 23 determines that the switch B is not pushed in step ST33 (step ST33, NO), the control part 23 determines whether or not the switch A and the switch B are pushed simultaneously (step ST35).

When the control part 23 determines that the switch A and the switch B are pushed simultaneously (step ST35, YES), the control part 23 performs the manual demonstration of the pointer movement. That is, the control part 23 drives the second drive circuit 27 and the third drive circuit 28 such that the chronograph 1/10 second hand 14 is moved by 5 scales in the backward rotational direction by reference to the storage part 39 for storing the number of times of backward rotation in the demonstration of the pointer movement and the chronograph second hand 15 is moved by 30 scales in the backward rotational direction by reference to the storage part 39 for storing the number of times of backward rotation in the demonstration of the pointer movement (step ST36).

Next, the control part 23 drives the second drive circuit 27 and the third drive circuit 28 such that the chronograph 1/10 second hand 14 is moved by 4 scales in the forward rotational direction by reference to the storage part 38 for storing the number of times of forward rotation in the demonstration of the pointer movement and the chronograph second hand 15 is moved by 29 scales in the forward rotational direction by reference to the storage part 38 for storing the number of times of forward rotation in the demonstration of the pointer movement (step ST37).

Then, the processing returns to step A shown in FIG. 5.

As described above, the electronic timepiece 10 according to this embodiment includes the manipulation part by which the chronograph 1/10 second hand 14 or the chronograph second hand 15 can be moved only in the forward rotational direction which is the clockwise direction due to the pushing of the switch A or the switch B in the correction mode (crown first-stage processing). With such constitution, in the automatic demonstration of the pointer movement for rotating the chronograph second hand 15, a moving amount (30-scale pointer movement) of the pointer due to the backward pointer movement in the counterclockwise direction which is the direction that the pointer is firstly moved and is the direction along which the correction cannot be made by the switch A and the switch B is set larger than a moving amount (29-scale pointer movement) of the pointer due to the forward pointer movement in the clockwise direction which is the direction along which the correction can be made by the switch A or the switch B.

Due to such constitution, for example, even when the motor drive polarity of the third drive circuit 28 is brought into an attractive state in the first 1-scale pointer movement in the automatic demonstration of the pointer movement, the chronograph second hand 15 which is positioned at the reference position of scale "0" in an initial state is moved by 29 scales in the counterclockwise direction and, thereafter, is moved by 29 scales in the clockwise direction. Accordingly, the chronograph secondhand 15 is returned to the reference position of the initial scale "0".

On the other hand, even when the motor drive polarity of the third drive circuit 28 is not brought into an attractive state in the first 1-scale pointer movement in the automatic demonstration of the pointer movement, the chronograph second hand 15 which is positioned at the reference position of scale "0" in an initial state is moved by 30 scales in the counterclockwise direction and, thereafter, is moved by 29 scales in the clockwise direction. Accordingly, the chronograph second hand 15 assumes a position of scale "59" which is displaced only by 1 scale in the counterclockwise direction from the reference position of scale "0". Accordingly, even when the pointer is not returned to the original position after the automatic demonstration of the pointer movement in this manner, it is possible to return the chronograph second hand 15 to the reference position of scale "0" by merely pushing the switch A one time. Due to the above-mentioned constitution, in correcting the positional displacement of the pointer caused by the demonstration of the pointer movement, a user can easily perform the correcting manipulation within a short time.

On the other hand, to consider a case where the pointer is moved by 30 scales in both the forward pointer movement and the backward pointer movement in the automatic demonstration of the pointer movement without using the present invention, when the motor drive polarity of the third drive circuit 28 is brought into an attractive state in the first 1-scale pointer movement, the chronograph second hand 15 which is positioned at the reference position of scale "0" in an initial state is moved by 29 scales in the counterclockwise direction and, thereafter, is moved by 30 scales in the clockwise direction. Accordingly, the chronograph second hand 15 assumes a position of scale "1" which is advanced by 1 scale in the clockwise direction from the reference position of scale "0".

Accordingly, in an attempt to return the chronograph 1/10 second hand 14 to the position of scale "0", for example, it is necessary for a user to rotate the chronograph 1/10 second hand 14 by one turn in the clockwise direction by pushing the switch A 10 times. This operation gives rise to a drawback that the correction manipulation imposes a burden on a user.

Further, when the chronograph second hand 15 is displaced to the position of scale "1" in the automatic demonstration of the pointer movement, by pushing the switch A 59 times, the chronograph secondhand 15 is rotated in the clockwise direction by 1 turn and returns to the position of scale "0" which is an original position of the chronograph second hand 15. In this case, however, the chronograph minute hand 16 is advanced by 1 scale. Accordingly, to correct the positional displacement of both the chronograph second hand 15 and the chronograph minute hand 16, it is necessary to push the switch B 3599 times thus giving rise to a drawback that a burden imposed on a user who performs the correct manipulation is increased.

The present invention can overcome the above-mentioned drawbacks and can enhance the manipulation by the user.

Further, to ease the correction of the positional displacement of the pointer caused by the automatic demonstration of the pointer movement, the addition of the manipulation which can perform not only the forward pointer movement but also the backward pointer movement in a correction mode may be considered.

However, as in the case of the constitution of the electronic timepiece 10 according to this embodiment which is provided with pointers which are respectively moved by two motors consisting of the chronograph 1/10-second display motor 30 and the chronograph second display motor 31 as the stopwatch function of the chronograph, the switch A and the switch B become necessary to correct the positional displacements of the pointers respectively. Accordingly, in this case, it is necessary to further provide switches by which the chronograph 1/10 second hand 14 and the chronograph second hand 15 are moved in the backward direction respectively in a correction mode and hence, there exists a possibility that a manufacturing cost is pushed up and the manipulation becomes complicated.

Further, it may be also considered that the number of stages of the crown 17 is increased so that a manipulation signal generated by the switch A and a manipulation signal generated by the switch B are changed over whereby it is possible to output manipulation signals by which the chronograph 1/10 secondhand 14 and the chronograph secondhand 15 can be moved in the backward direction respectively in a correction mode. In this case, however, the system becomes complicated and hence, there exists a possibility that a manufacturing cost is pushed up and the manipulation becomes complicated.

Accordingly, also from a viewpoint of the simplification of the system and the reduction of the manufacturing cost, it is advantageous to correct the positional displacements of the pointers using the automatic demonstration of the pointer movement as in the case of the present invention.

Second Embodiment

Next, a second embodiment of the present invention is explained. In this embodiment, constitutional parts substantially equal to the constitutional parts explained in conjunction with the first embodiment are given same symbols and the detailed explanation of these parts is omitted.

FIG. 8 is a view for explaining one example of functions of an electronic timepiece 100 according to this embodiment.

As shown in FIG. 8, a function of a switch A, a function of a switch B and a function of a crown in a state where the crown is positioned at a zero stage, and the function of the switch A, the function of the switch B and the function of the crown in a state where the crown is positioned at a first stage are equal to the corresponding functions of the switches A, B and the crown in the first embodiment.

The electronic timepiece 100 according to this embodiment possesses following functions in addition to the above-mentioned functions.

That is, when the electronic timepiece 100 is in a state where the crown is positioned at a zero stage and the demonstration of the pointer movement is being performed by the control part 23, by pushing the switch A one time in the direction G, the rotation of a chronograph 1/10 second hand 14, the rotation of a chronograph second hand 15 and the rotation of a chronograph minute hand 16 are stopped so that the demonstration of the pointer movement is interrupted.

When the electronic timepiece 100 is in a state where the crown is positioned at a first stage and the demonstration of the pointer movement is being performed by the control part 23, by pushing the switch B one time in the direction H, the rotation of the chronograph 1/10 second hand 14, the rotation of the chronograph second hand 15 and the rotation of the chronograph minute hand 16 are stopped so that the demonstration of the pointer movement is interrupted.

Figure 9:
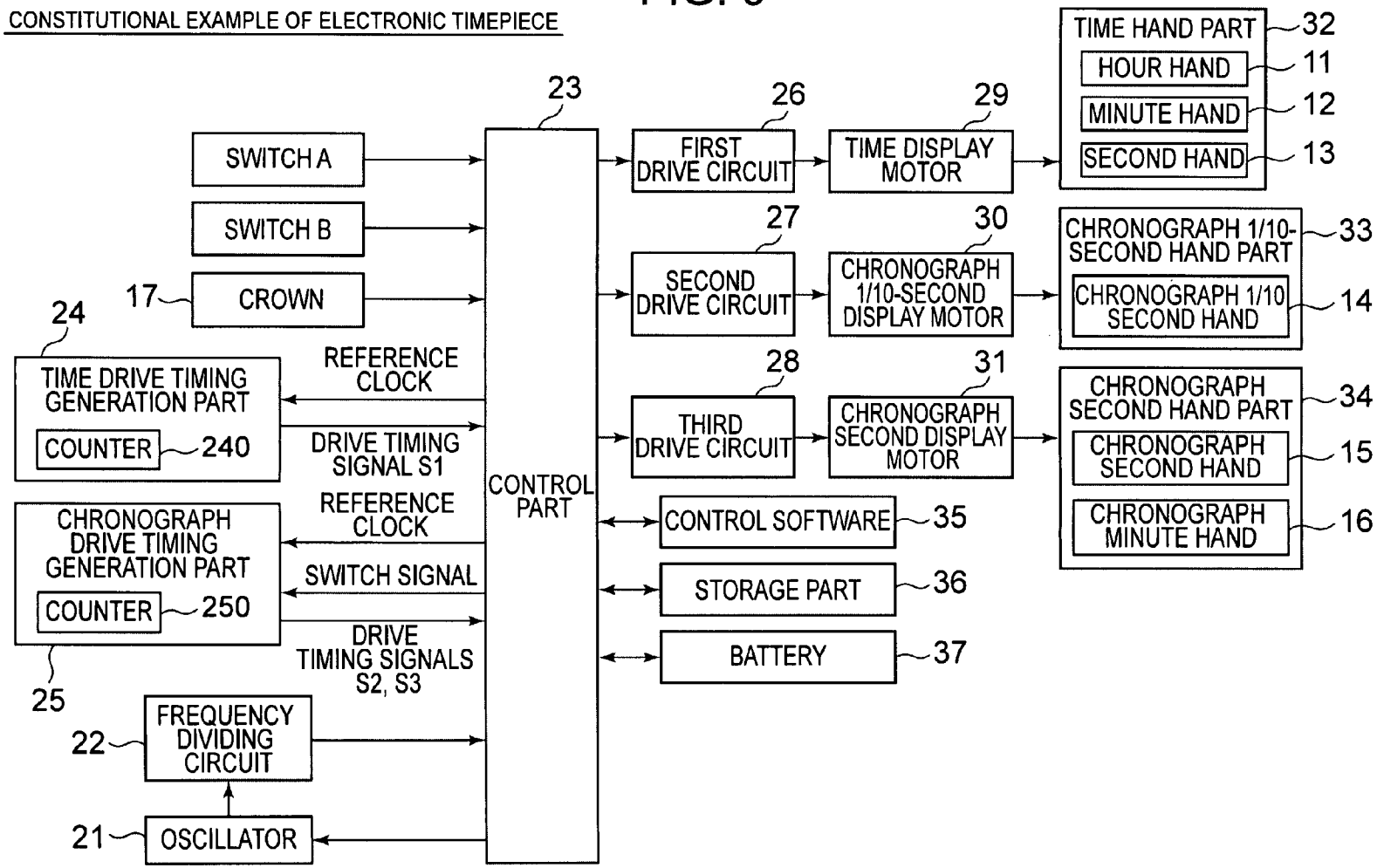
FIG. 9 is a block diagram for explaining one example of a control system of the electronic timepiece according to the second embodiment of the present invention.

Next, one example of the constitution of the electronic timepiece 100 according to this embodiment is explained in conjunction with FIG. 9. FIG. 9 is a view showing one example of the constitution of the electronic timepiece 100 according to this embodiment.

As shown in FIG. 9, the electronic timepiece 100 according to this embodiment differs from the electronic timepiece 10 according to the first embodiment shown in FIG. 3 with respect to a point that the electronic timepiece 100 of this embodiment does not include the storage part 38 for storing the number of times of forward rotation in the demonstration of the pointer movement and the storage part 39 for storing the number of times of backward rotation in the demonstration of the pointer movement which the electronic timepiece 10 of the first embodiment includes.

Further, in a control software program which is stored in control software 35 according to this embodiment, it is preset that, in the demonstration of the pointer movement, pointers are moved in the backward direction with the preset number of times of backward rotation in the demonstration of the pointer movement and, thereafter, the pointers are moved in the forward direction with the preset number of times of forward rotation in the demonstration of the pointer movement. It is also preset that the demonstration of the pointer movement is interrupted when the switch A or the switch B is pushed in the middle of the demonstration of the pointer movement. In this embodiment, both the number of times of forward rotation in the demonstration of the pointer movement and the number of times of backward rotation in the demonstration of the pointer movement are set to 30 scales (30-scale pointer movement).

Further, a storage part 36 according to this embodiment, in the demonstration of the pointer movement, stores the number of times (scale value) of forward rotation in the demonstration of the pointer movement in which the chronograph 1/10 second hand 14 and the chronograph second hand 15 are moved in the forward direction by the control part 23, and the number of times (scale value) of backward rotation in the demonstration of the pointer movement in which the chronograph 1/10 second hand 14 and the chronograph second hand 15 are moved in the backward direction by the control part 23.

That is, in the demonstration of the pointer movement, when a user pushes the switch A or the switch B in the middle of the rotations of the chronograph 1/10 second hand 14 and the chronograph second hand 15 in the clockwise direction after being rotated in the counterclockwise direction from the reference position by reference to the storage part 36, for example, the control part 23 interrupts the demonstration of the pointer movement. Due to such an operation, the demonstration of the pointer movement can be performed such that the pointer is set to a position where a rotational angle of the pointer in the clockwise direction from the reference position becomes smaller than a rotational angle of the pointer in the counterclockwise direction from the reference position.

As described previously, the chronograph 1/10 second hand 14, the chronograph second hand 15 and the chronograph minute hand 16 are rotated only in the clockwise direction based on a manipulation signals which is inputted from the control part 23 when a user manipulates the switch A, B, the crown or the like.

Figure 10:
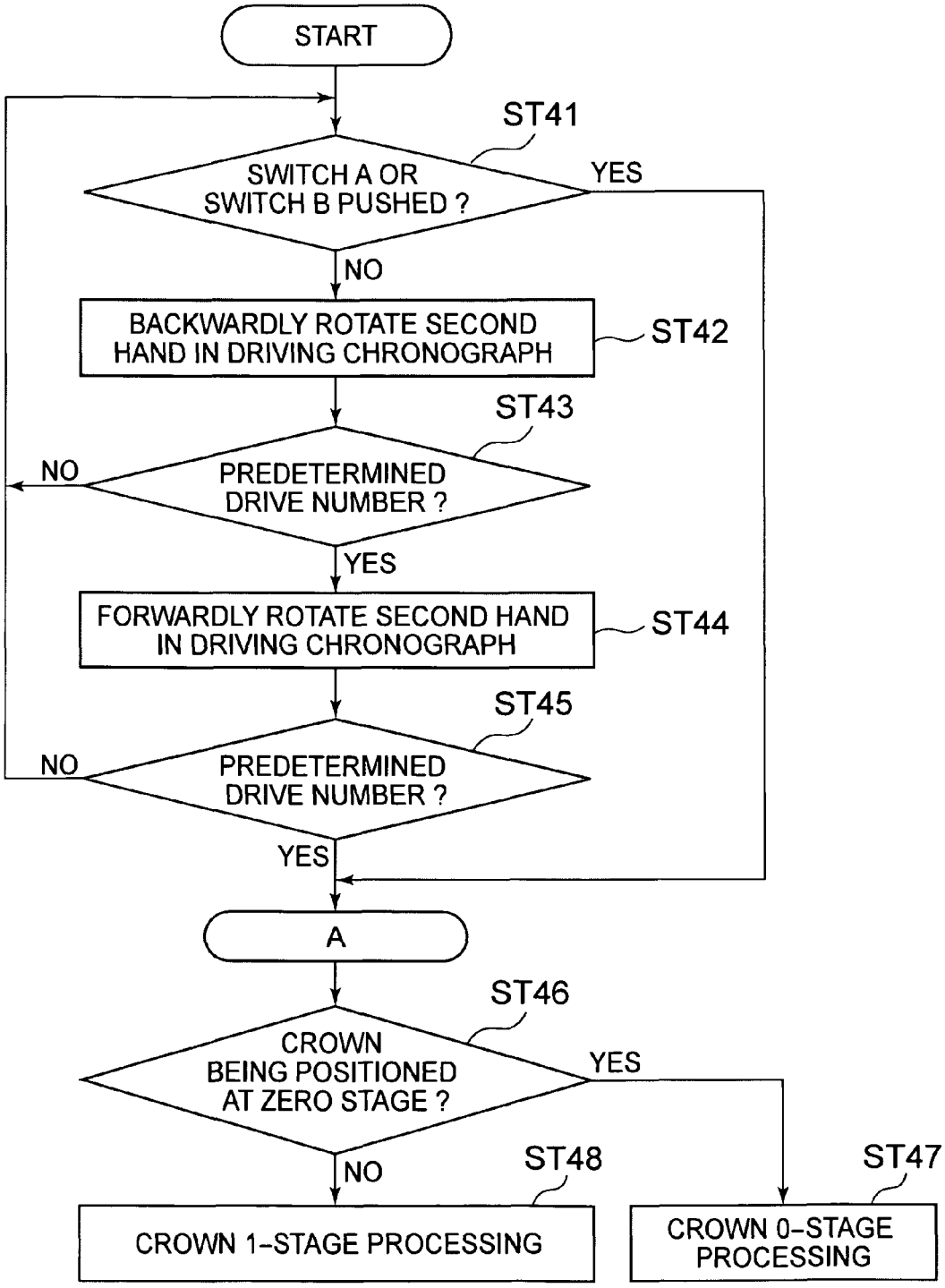
FIG. 10 is a flowchart for explaining one example of an operation flow of the automatic demonstration of the pointer movement of the electronic timepiece according to the second embodiment of the present invention.

Next, the manner of operation of the electronic timepiece 100 is explained in conjunction with FIG. 10.

FIG. 10 is a flowchart for explaining a flow of the demonstration of the pointer movement of the electronic timepiece 100.

As shown in FIG. 10, for example, when a battery is exchanged by a user, electricity of the exchanged battery 37 is supplied to the control part 23. In response to such an operation, the control part 23 determines the supply of electricity by reference to the control software 35, and starts the demonstration of the pointer movement. Further, the control part 23 supplies electricity from the battery 37 to the oscillator 21 and obtains a reference clock signal from the oscillator 21.

The control part 23 determines whether or not the switch A or the switch B is pushed (step ST41). Then, when the control part 23 does not detect that the switch A or the switch B is pushed, the control part 23 drives a third drive circuit 28 so that the chronograph second hand 15 is moved in the backward rotational direction by 1 scale (step ST42). Here, the control part 23 counts the number of times of the pointer movement of the chronograph second hand 15 in the backward rotational direction by making use of a counter incorporated in the control part 23, and temporarily stores the counted number in a storage part incorporated in the control part 23.

Next, the control part 23 determines whether or not the number of times of the pointer movement in the backward rotational direction which is temporarily stored arrives at the number of times of backward rotation in the demonstration of the pointer movement (step ST43). When the control part 23 determines that the number of times of the pointer movement in the backward rotational direction does not arrive at the number of times of backward rotation in the demonstration of the pointer movement (step ST43, NO), the control part 23 returns the processing to step ST41.

On the other hand, when the control part 23 determines that the number of times of the pointer movement in the backward rotational direction when the pointer is actually rotated in the counterclockwise direction arrives at the number of times of forward rotation in the demonstration of the pointer movement (step ST43, YES), the control part 23 drives the third drive circuit 28 so that the chronograph second hand 15 is moved in the forward rotational direction by 1 scale (step ST44). Here, the control part 23 counts the number of times of the pointer movement in the forward rotational direction by making use of the counter incorporated in the control part 23 and temporarily stores the counted number in the storage part incorporated in the control part 23.

Next, the control part 23 reads the number of times of forward rotation (30-scale pointer movement) in the demonstration of the pointer movement which is stored in the storage part 36 and determines whether or not the number of times of the pointer movement in the forward rotational direction which is temporarily stored arrives at the number of times of forward rotation in the demonstration of the pointer movement (step ST45). When it is determined that the temporarily stored number of times of the pointer movement in the forward rotational direction does not arrives at the number of times of forward rotation in the demonstration of the pointer movement (step ST45, NO), the control part 23 returns the processing to step ST41.

In this demonstration of the pointer movement, the third drive circuit 28 stores a drive polarity at the time of finishing the demonstration of the pointer movement in a storage part thereof.

Next, the control part 23 determines whether the crown 17 is in a state where the crown is positioned at a first stage or in a state where the crown is positioned at a zero stage (step ST46).

When the control part 23 determines that the crown 17 is in a state where the crown is positioned at a zero stage (step ST46, YES), the processing advances to crown zero-stage processing (step ST47). On the other hand, when the control part 23 determines that the crown 17 is in a state where the crown is positioned at a first stage (step ST46, NO), the processing advances to crown first-stage processing (step ST48).

Figure 11:
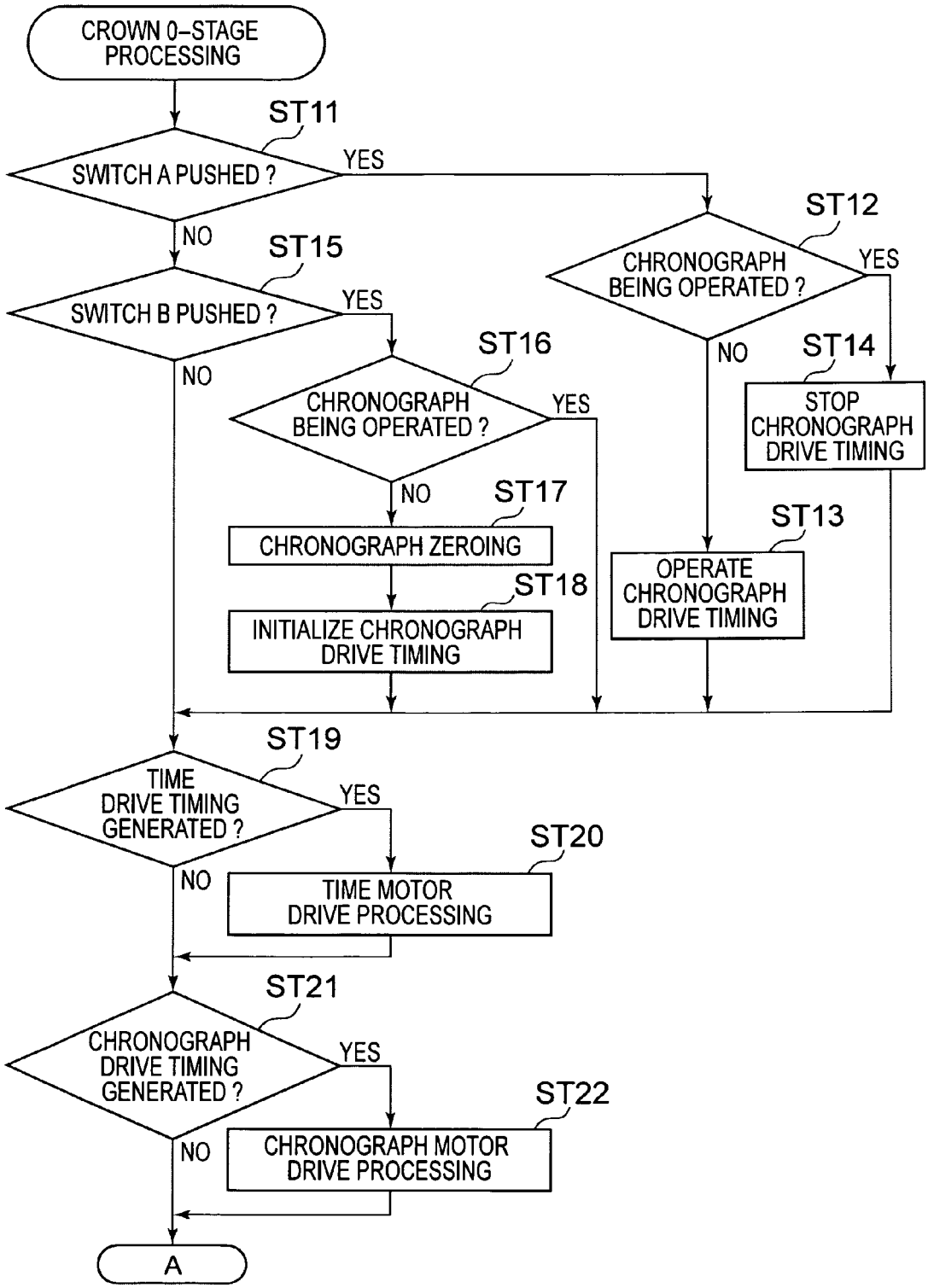
FIG. 11 is a flowchart for explaining one example of an operation flow of processing of the electronic timepiece according to the second embodiment of the present invention when a crown is positioned at a zero stage.
Figure 12:
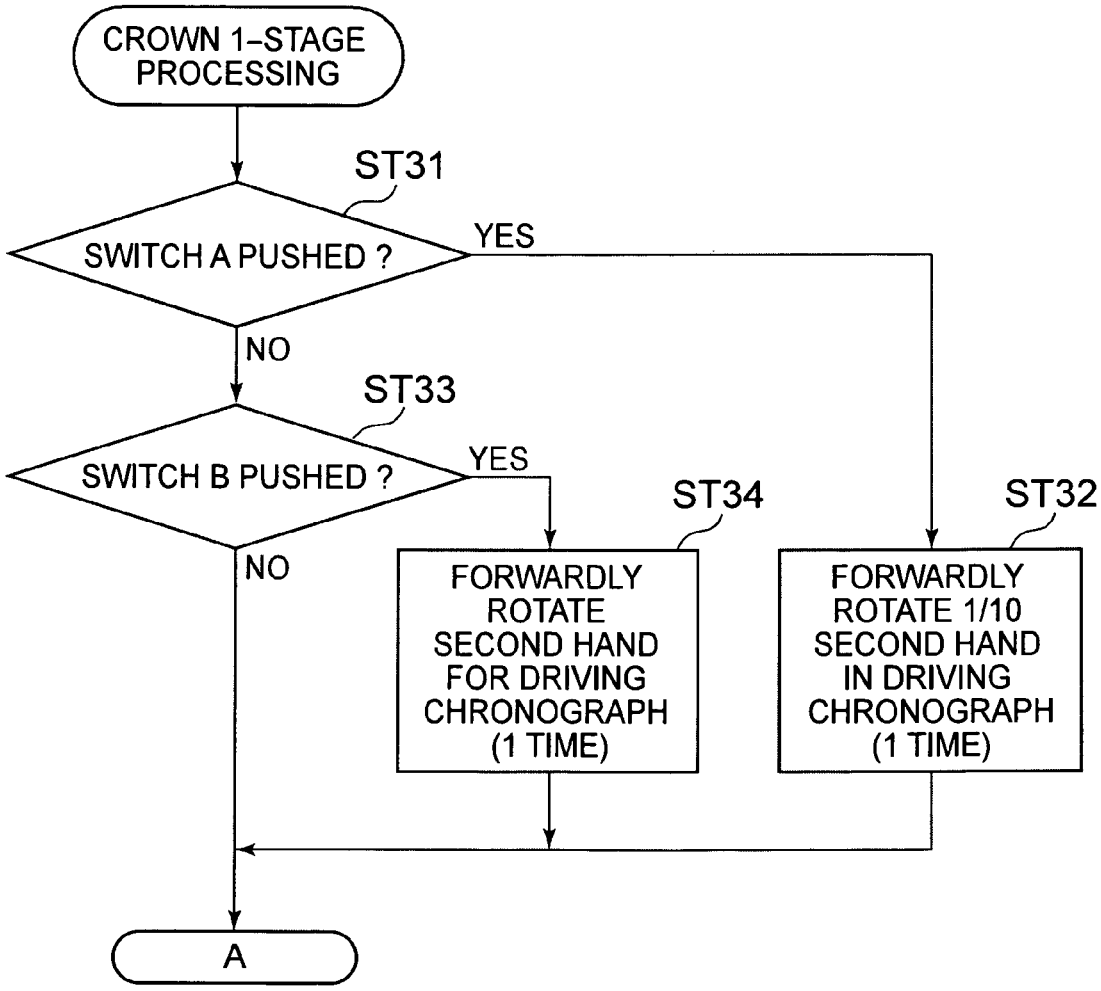
FIG. 12 is a flowchart for explaining one example of an operation flow of processing of the electronic timepiece according to the second embodiment of the present invention when a crown is positioned at a first stage.

In the above explanation of the processing, the electronic timepiece 100 of this embodiment can also execute operations substantially equal to the operations explained in conjunction with FIG. 6 and FIG. 7. These operations are shown in FIG. 11 and FIG. 12. However, the detailed explanation of these operations is omitted.

As described above, the electronic timepiece 100 according to this embodiment includes the manipulation part (switch A or switch B) by which the chronograph 1/10 second-hand 14 or the chronograph second hand 15 can be moved only in the forward rotational direction which is the clockwise direction due to the pushing of the switch A or the switch B in the correction mode (crown first-stage processing). With such constitution, when the switch A or the switch B is pushed in the midst of the demonstration of the pointer movement, the control part 23 stops the rotation of the chronograph 1/10 second hand 14 and the rotation of the chronograph second hand 15 so as to interrupt the demonstration of the pointer movement.

Accordingly, a user can, by pushing the switch A or the switch B in the midst of the demonstration of the pointer movement, stop the chronograph 1/10 second hand 14 or the chronograph second hand 15 in the counterclockwise direction within a half turn from the reference position in the counterclockwise direction before the demonstration of the pointer movement is started.

For example, to consider the case where the pointer completes 1 turn by 60-scale pointer movement as described previously, when the pointer is moved in the counterclockwise direction by 30-scale pointer movement and, thereafter, is moved in the clockwise direction by 30-scale pointer movement in the demonstration of the pointer movement, the chronograph second hand 15 is stopped at a position between a scale "30" and a scale "60" in response to pushing of the switch A or the switch B by a user in the midst of the demonstration of the pointer movement. That is, when the reference position is set at a position of scale "0", the chronograph second hand 15 can be stopped within a range from a scale "0" to a scale "59, 58, 57, . . . , 32, 31 or 30" in the counterclockwise direction (within scales "30 to 59, and 0").

When a motor drive polarity of the third drive circuit 28 is brought into an attractive state in the first 1 scale in the demonstration of the pointer movement, the chronograph secondhand 15 is moved in the clockwise direction by 30 scales after being moved in the counterclockwise direction by 29 scales. Accordingly, unless the demonstration of the pointer movement is interrupted by the user, the chronograph secondhand 15 which is at the reference position of scale "0" before the demonstration of the pointer movement is started is stopped at a position of scale "1". Accordingly, to return the chronograph second hand 15 to the reference position of scale "0", for example, when the chronograph minute hand 16 is moved by 60 scales corresponding to 60 minutes or the like, it is necessary to move the chronograph second hand 15 by 3599 scales in the clockwise direction by pushing the switch A 3599 times. Although a method in which the chronograph second hand 15 is automatically and continuously moved by continuously pushing the switch A may be considered, it is thought that this method takes a considerable amount of time for correction.

To the contrary, according to the electronic timepiece of the present invention, the chronograph second hand 15 can be stopped in the midst of the demonstration of the pointer movement and hence, the chronograph second hand 15 is stopped at a position between the scale "30" and the scale "60". Accordingly, it is possible to return the chronograph second hand 15 to the position of scale "0" by moving the chronograph second hand 15 in the clockwise direction by pushing the switch A 30 times at maximum. Therefore, when there exists a possibility that a position of the pointer is displaced by the demonstration of the pointer movement, a user can instruct the interruption of the demonstration of the pointer movement in the midst of the demonstration of the pointer movement so that a burden imposed on a user at the time of performing the manipulation to return the pointer to an original position, and the user can correct the positional displacement within a shorter time.

Further, to ease the correction of the positional displacement of the pointer caused by the demonstration of the pointer movement, the addition of the manipulation which can perform not only the forward pointer movement but also the backward pointer movement in a correction mode may be considered.

However, as in the case of the constitution of the electronic timepiece 100 according to this embodiment which is provided with pointers which are respectively moved by two motors consisting of the chronograph 1/10-second display motor 30 and the chronograph second display motor 31 as the stopwatch function of the chronograph, the switch A and the switch B become necessary to correct the positional displacements of the pointers respectively. Accordingly, in this case, it is necessary to further provide switches by which the chronograph 1/10 second hand 14 and the chronograph second hand 15 are moved in the backward direction respectively in a correction mode and hence, there exists a possibility that a manufacturing cost is pushed up and the manipulation becomes complicated.

Further, it may be also considered that the number of stages of the crown 17 is increased so that a manipulation signal generated by the switch A and a manipulation signal generated by the switch B are changed over whereby it is possible to output manipulation signals by which the chronograph 1/10 second hand 14 and the chronograph second hand 15 can be moved in the backward direction respectively in a correction mode. In this case, however, the system becomes complicated and hence, there exists a possibility that a manufacturing cost is pushed up and the manipulation becomes complicated.

Accordingly, also from a viewpoint of the simplification of the system and the reduction of the manufacturing cost, it is advantageous to correct the positional displacements of the pointers using the automatic demonstration of the pointer movement as in the case of the present invention.

Here, the present invention is not limited to the above-mentioned embodiments, and may have the following constitution.

For example, in the above-mentioned embodiments, the explanation has been made with respect to the case where the control part 23 performs the demonstration of the pointer movement when the control part 23 detects the supply of electricity from the battery 37. However, the present invention is not limited to such a constitution. For example, when an operation mode is changed over from a correction mode to a normal mode by pushing the crown 17, the control part 23 may detect the pushing of the crown 17 and may perform the demonstration of the pointer movement.

Third Embodiment

Next, a third embodiment of the present invention is explained. Here, constitutional parts of this embodiment which are substantially equal to the constitutional parts explained in conjunction with the first embodiment are given same symbols and the detailed explanation of these parts is omitted.

Figure 13:
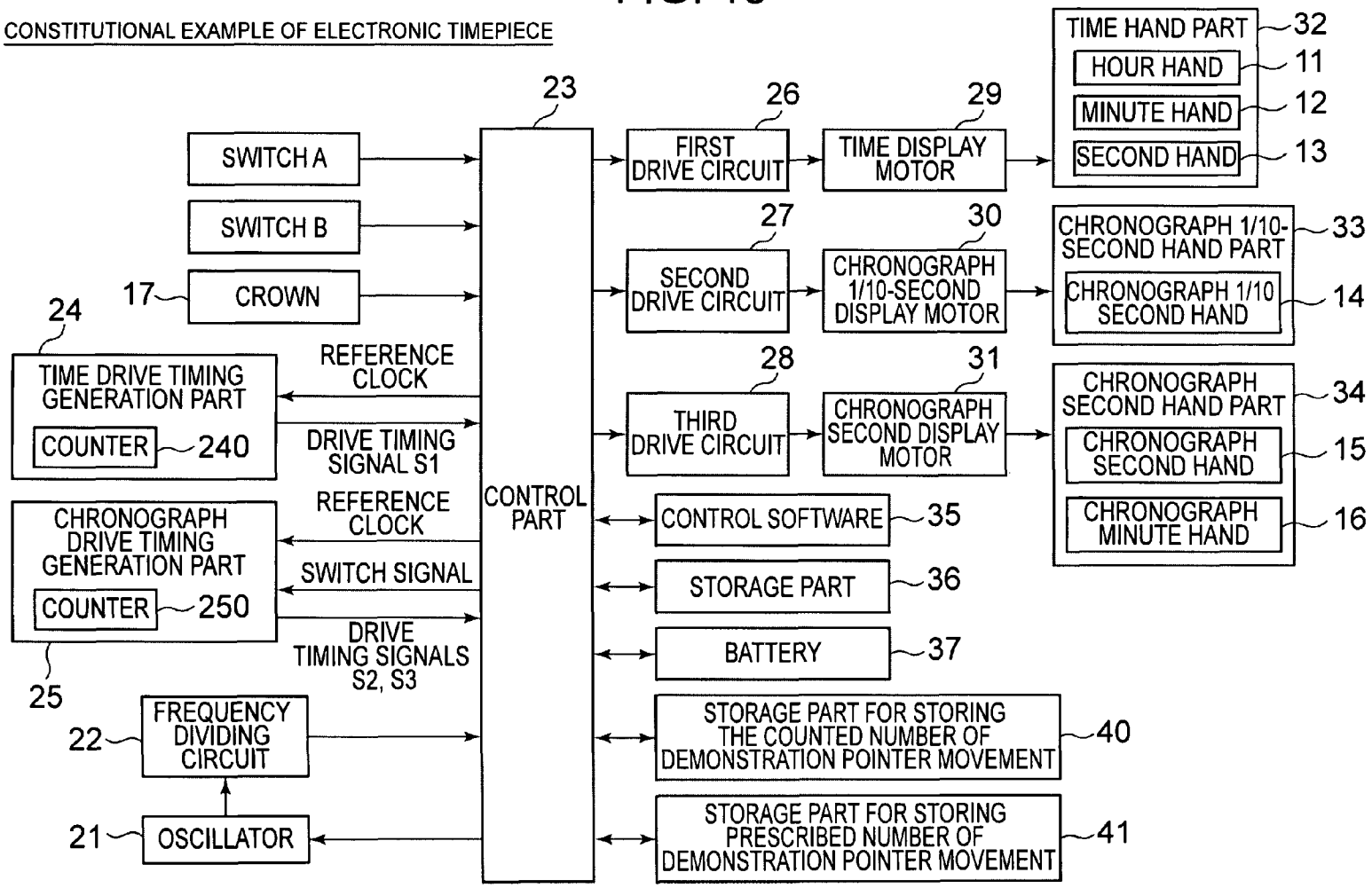
FIG. 13 is a block diagram for explaining one example of a control system of the electric timepiece according to a third embodiment of the present invention.

One example of the constitution of an electronic timepiece 200 according to this embodiment is explained in conjunction with FIG. 13. FIG. 13 is a view showing one example of the constitution of the electronic timepiece 200 according to this embodiment.

As shown in FIG. 13, the electronic timepiece 200 according to this embodiment differs from the electronic timepiece 10 according to the first embodiment shown in FIG. 3 with respect to a point that the electronic timepiece 200 of this embodiment includes a storage part 40 for storing the counted number of demonstration pointer movement and a storage part 41 for storing prescribed number of demonstration pointer movement in place of the storage part 38 for storing the number of times of forward rotation in the demonstration of the pointer movement and the storage part 39 for storing the number of times of backward rotation in the demonstration of the pointer movement.

The storage part 40 for storing the counted number of demonstration pointer movement stores the counted number of demonstration pointer movement which is the number of times that the pointer is moved at the time of demonstration of the pointer movement and is counted by the control part 23 at the time of the demonstration of the pointer movement. The counted number of demonstration pointer movements is "0" in an initial state. The counted number of the demonstration of the pointer movement being "1" means that a chronograph 1/10 second hand 14 or a chronograph second hand 15 is moved only by 1 scale respectively. That is, the number of counts of the demonstration of the pointer movement being "1" means a moving amount of the pointer by one scale. Here, the storage part 40 for storing the counted number of demonstration pointer movements stores the counted number of demonstration pointer movements which is obtained by counting for every pointer. In this embodiment, the explanation is made hereinafter by taking the demonstration of the pointer movement of the chronograph second hand 15 as an example while omitting the corresponding explanation of the chronograph 1/10 second hand 14.

The storage part 41 for storing the prescribed number of demonstration pointer movement stores the prescribed number of demonstration pointer movement which is preset as the number of times that the pointer is moved in the demonstration of the pointer movement. In this embodiment, the demonstration of the pointer movement is performed such that the pointer is firstly rotated in the counterclockwise direction and, thereafter, is rotated in the clockwise direction. Accordingly, the prescribed number of demonstration pointer movement is the number of times that the pointer is moved at a turning point in the demonstration of the pointer movement. In other words, the prescribed number of demonstration pointer movement is the number of times the pointer is rotated in the counterclockwise direction which is the first rotational direction. Here, the prescribed number of demonstration pointer movement is preset to "30". Here, the storage part 41 for storing prescribed number of demonstration pointer movement stores the prescribed number of demonstration pointer movement preset for every pointer. In this embodiment, the explanation is made hereinafter by taking the demonstration of the pointer movement of the chronograph second hand 15 as an example while omitting the corresponding explanation of the chronograph 1/10 second hand 14.

Figure 14:
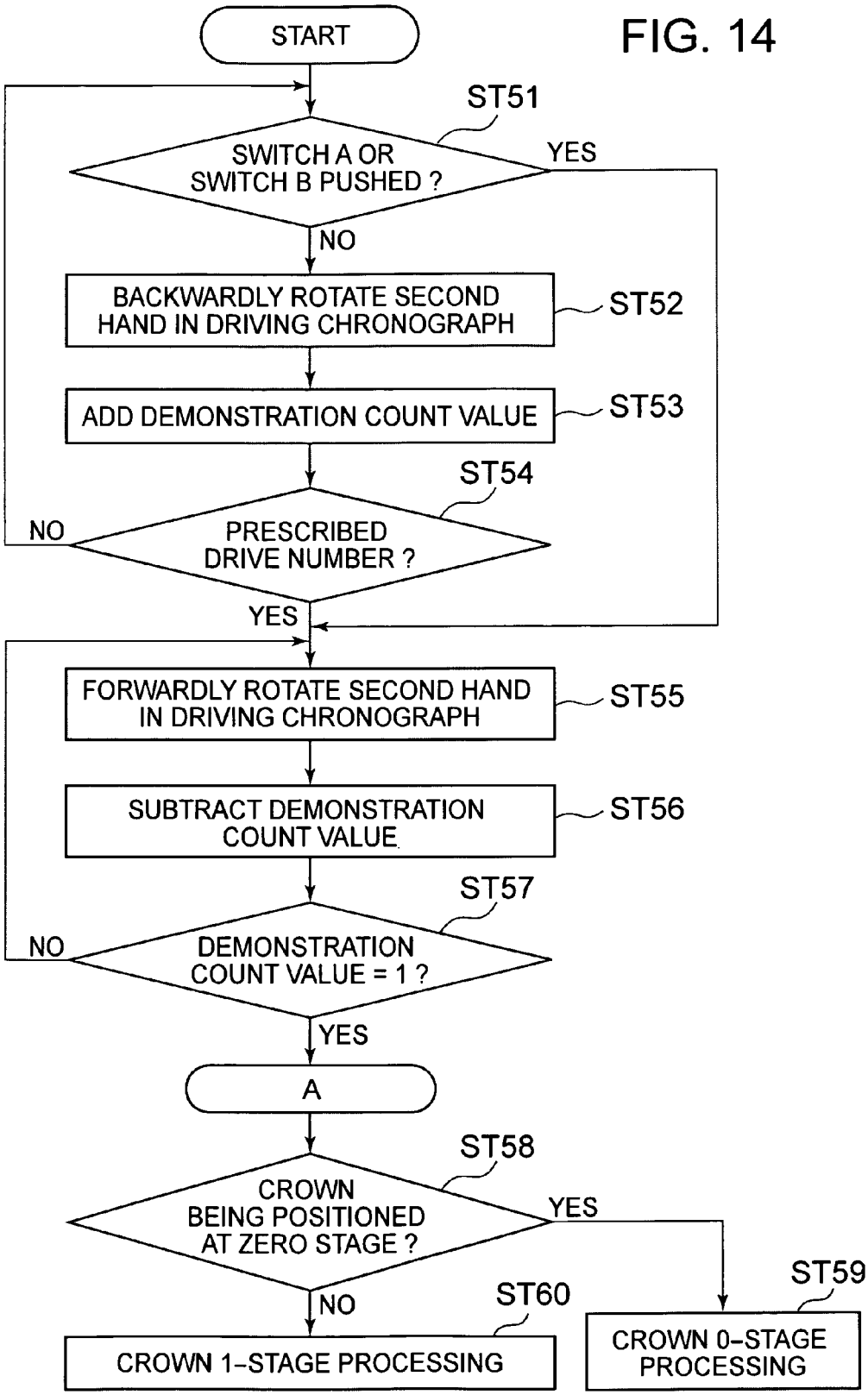
FIG. 14 is a flowchart for explaining one example of an operation flow of automatic pointer movement of the electronic timepiece according to the third embodiment of the present invention.
Figure 15A:
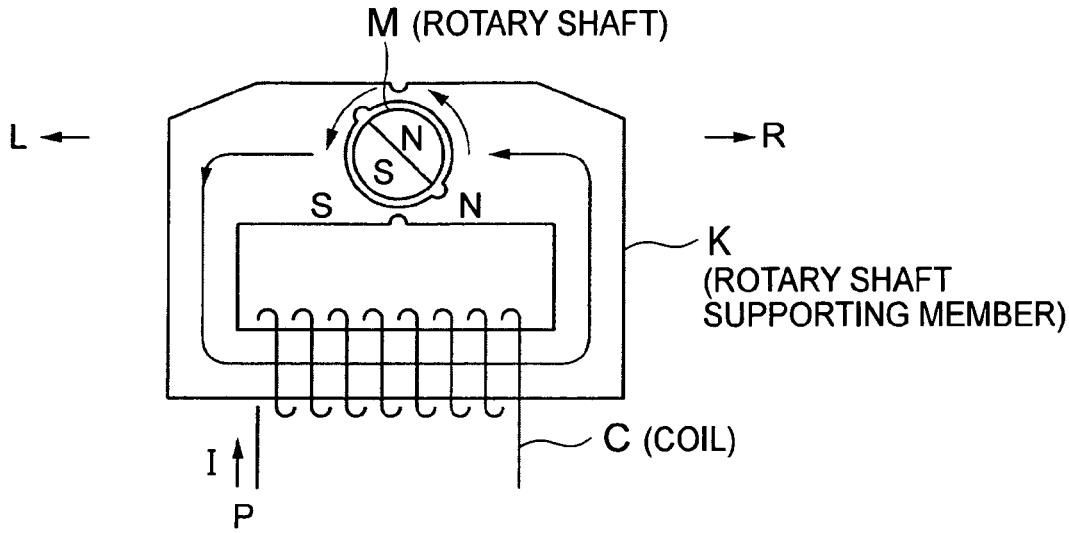
FIG. 15A is a view for explaining a motor driving polarity of a motor.
Figure 15B:
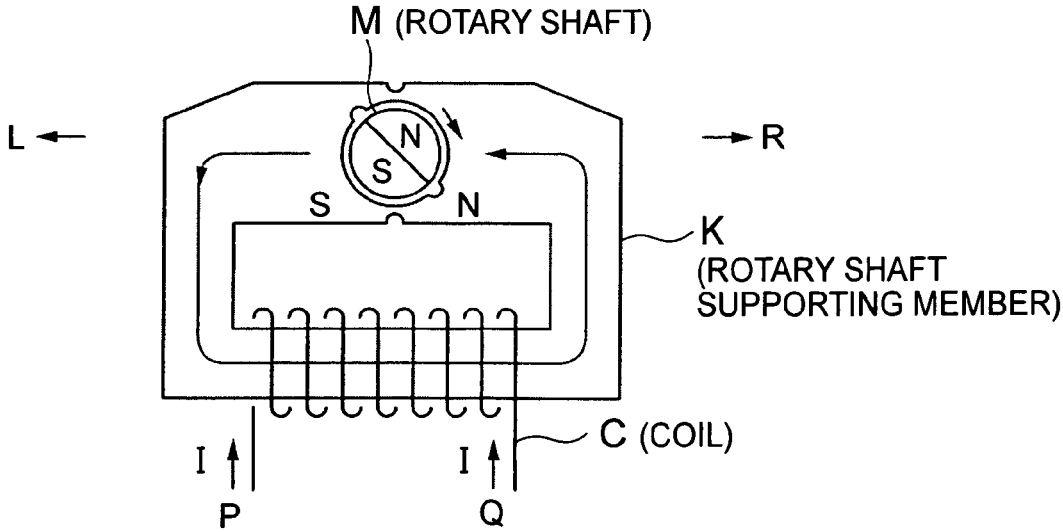
FIG. 15B is a view for explaining a motor driving polarity of the motor.

Next, one example of a processing flow of the automatic demonstration of the pointer movement of the electronic timepiece 200 according to this embodiment is explained in conjunction with FIG. 14. FIG. 14 is a flowchart for explaining the processing flow of the automatic demonstration of the pointer movement of the electronic timepiece 200.

As shown in FIG. 14, for example, when a battery is exchanged by a user, electricity of the exchanged battery 37 is supplied to the control part 23. In response to such an operation, the control part 23 determines the supply of electricity by reference to the control software 35, and starts the demonstration of the pointer movement. Further, the control part 23 supplies electricity from the battery 37 to the oscillator 21 and obtains a reference clock signal from the oscillator 21.

The control part 23 determines whether or not the switch A or the switch B is pushed (step ST51). Then, when the control part 23 does not detect that the switch A or the switch B is pushed, the control part 23 drives a third drive circuit 28 so that the chronograph second hand 15 is moved in the backward rotational direction by 1 scale (step ST52). Here, the control part 23 counts the number of times of the pointer movement of the chronograph second hand 15 in the backward rotational direction by making use of a counter incorporated in the control part 23. Then, the control part 23 adds the counted number of times of the pointer movement to the counted number of demonstration pointer movement which the storage part 40 for storing the counted number of demonstration pointer movement stores (step ST53).

In an initial state, the counted number of demonstration pointer movement which the storage part 40 for storing the counted number of demonstration pointer movement stores is "0", and the control part 23 adds the number of times of the pointer movement "1" which indicates 1-scale pointer movement in step ST52 to the counted number of demonstration pointer movement "0". Accordingly, the counted number of demonstration pointer movement which the storage part 40 for storing the counted number of demonstration pointer movement stores becomes "1". That is, in this embodiment, the rotational direction that the positional displacement of the chronograph second hand 15 can be corrected in a correction mode is the clockwise direction. Accordingly, the control part 23 adds symbol "+" to the number of times of the pointer movement of the pointer in the counterclockwise direction which is the direction opposite to the rotational direction that the positional displacement of the pointer can be corrected, and makes the storage part 40 for storing the counted number of demonstration pointer movement store the number of times of the pointer movement in the counterclockwise direction as the counted number of the demonstration of the pointer movement.

Next, the control part 23 determines whether or not the counted number of demonstration pointer movement stored in the storage part 40 for storing the counted number of demonstration pointer movement arrives at the prescribed number of demonstration pointer movement stored in the storage part 41 for storing the prescribed number of demonstration pointer movement (step ST54). When it is determined that the counted number of demonstration pointer movement does not arrive at the prescribed number of demonstration pointer movement (step ST54, NO), the control part 23 returns the processing to step ST51.

Then, in step ST51, when the control part 23 does not detect that the switch A or the switch B is pushed, the control part 23 drives the third drive circuit 28 such that the chronograph second hand 15 is moved in the counterclockwise direction (backward rotational direction) by 1 scale. Next, in step ST53, the control part 23 adds the counted number of times of the pointer movement to the counted number of demonstration pointer movement which is stored in the storage part 40 for storing the counted number of demonstration pointer movement. That is, the counted number of demonstration pointer movement stored in the storage part 40 for storing the counted number of demonstration pointer movement is "1" and hence, the control part 23 adds the number of times of the pointer movement "1" in step ST52 to the counted number of demonstration pointer movement "1". Accordingly, the counted number of demonstration pointer movement which the storage part 40 for storing the counted number of demonstration pointer movement stores becomes "1".

The control part 23 repeats the processing in step ST52 and the processing in step ST53 until the switch A or the switch B is pushed in step ST51. When the switch A or the switch B is pushed before the counted number of demonstration pointer movement arrives at the prescribed number of demonstration pointer movement (step ST51, YES), the control part 23 advances the processing to step ST55. That is, when the switch A or the switch B is pushed by the user in the midst of the rotation of the chronograph second hand 15 in the counterclockwise direction, even when the counted number of demonstration pointer movement is smaller than the prescribed number of demonstration pointer movement, the control part 23 finishes the pointer movement in the counterclockwise direction and changes over the pointer movement to the pointer movement in the clockwise direction performed in steps which come after step ST55.

Alternatively, when the control part 23 determines that the counted number of demonstration pointer movement arrives at the prescribed number of demonstration pointer movement (step ST54, YES), the control part 23 advances the processing to step ST55. That is, even when the switch A or the switch B is not pushed by the user in the midst of the rotation of the chronograph second hand 15 in the counterclockwise direction, at a stage that the counted number of demonstration pointer movement arrives at the prescribed number of demonstration pointer movement, the control part 23 finishes the pointer movement in the counterclockwise direction and changes over the pointer movement to the pointer movement in the clockwise direction performed in steps which come after step ST55.

Then, the control part 23 drives the third drive circuit 28 and moves the chronograph second hand 15 in the forward rotational direction by 1 scale (step ST55). Next, the control part 23 subtracts "1" from the counted number of demonstration pointer movement stored in the storage part 40 for storing the counted number of demonstration pointer movement (step ST56). That is, in this embodiment, the rotational direction that the positional displacement of the chronograph second hand 15 can be corrected in a correction mode is the clockwise direction. Accordingly, the control part 23 adds symbol "−" to the number of times of the pointer movement of the pointer in the clockwise direction which is the same direction as the rotational direction that the positional displacement of the pointer can be corrected, and makes the storage part 40 for storing the counted number of demonstration pointer movement store the number of times of the pointer movement in the clockwise direction as the counted number of demonstration pointer movement.

Next, the control part 23 determines whether or not the counted number of demonstration pointer movement stored in the storage part 40 for storing the counted number of demonstration pointer movement is "1" (step ST57). When the control part 23 determines that the counted number of demonstration pointer movement is not "1" (step ST57, NO), the control part 23 returns the processing to step ST55. Then, the control part 23 repeats the processing in step ST55 and the processing in step ST56 until the counted number of demonstration pointer movement becomes "1" in step ST57. Then, when the counted number of demonstration pointer movement becomes "1" in step ST57, the control part 23 finishes the pointer movement of the chronograph second hand 15 in the clockwise direction (step ST57, YES).

In this demonstration of the pointer movement, the third drive circuit 28 stores a drive polarity at the time of finishing the demonstration of the pointer movement in a storage part thereof.

In the above-mentioned step ST51, when the switch A or the switch B is pushed so that the processing advances to step ST55, the counted number of demonstration pointer movement stored in the storage part 40 for storing the counted number of demonstration pointer movement is a value smaller than the prescribed number of the demonstration of the pointer movement "30".

For example, assume that the switch A or the switch B is pushed in the midst of the movement of the chronograph second hand 15 in the counterclockwise direction in the demonstration of the pointer movement. When the counted number of demonstration pointer movement at the time of pushing the switch A or B is "15", the control part 23 rotates the chronograph second hand 15 in the counterclockwise direction from the reference position by 15 scales. The control part 23, without rotating the pointer by an amount of 30 scales which is the prescribed number of demonstration pointer movement, rotates the chronograph second hand 15 in the clockwise direction by reversing the rotational direction from a position at the time of pushing the switch A or the switch B, that is, a position which is displaced from the reference position by 15 scales in the counterclockwise direction. Here, as explained in the above-mentioned step ST57, the control part 23 finishes the rotation of the pointer in the clockwise direction when the number of counts of the rotation in the clockwise direction arrives at the number smaller than the counted number of demonstration pointer movement by "1". That is, the control part 23 rotates the chronograph second hand 15 in the clockwise direction by 14 scales.

Accordingly, when the pointer is normally rotated in the first rotation, the actual number of times of rotation of the pointer and the counted number of demonstration pointer movement are equal and hence, the pointer after finishing the demonstration of the pointer movement is at a position which ascends in the counterclockwise direction only by 1 scale from the reference position. On the other hand, when the pointer is not normally rotated in the first rotation, the actual number of times of rotations of the pointer is smaller than the counted number of demonstration pointer movement only by "1". Accordingly, the pointer after finishing the demonstration of the pointer movement is at the reference position.

The above-mentioned case where the switch A or the switch B is pushed in the midst of the demonstration of the pointer movement is specifically explained.

For example, even when the motor drive polarity of the third drive circuit 28 is brought into an attractive state in the first 1-scale pointer movement in the automatic demonstration of the pointer movement, the chronograph second hand 15 which is at the reference position of scale "0" in an initial state is moved in the counterclockwise direction by 14 scales and, thereafter, is moved in the clockwise direction by 14 scales. Accordingly, the chronograph second hand 15 returns to the reference position of scale "0" where the chronograph second hand 15 is positioned in an initial state.

On the other hand, even when the motor drive polarity of the third drive circuit 28 is not brought into an attractive state in the first 1-scale pointer movement in the automatic demonstration of the pointer movement, the chronograph second hand 15 which is at the reference position of scale "0" in an initial state is moved in the counterclockwise direction by 15 scale and, thereafter, is moved in the clockwise direction by 14 scale. Accordingly, the chronograph second hand 15 is at a position of scale "59" which is displaced only by 1 scale from the reference position of scale "0" in the counterclockwise direction. In this manner, even when the pointer does not return to the original position after the automatic demonstration of the pointer movement, it is possible to return the chronograph second hand 15 to the reference position of scale "0" by merely pushing the switch A one time. Accordingly, in correcting the positional displacement of the pointer caused by the demonstration of the pointer movement, a user can easily perform the correction manipulation within a short time.

That is, in the demonstration of the pointer movement, the control part 23 performs the demonstration of the pointer movement such that the pointer is positioned at a position where a rotational angle of the pointer in the clockwise direction from the reference position becomes smaller than a rotational angle of the pointer in the counterclockwise direction from the reference position.

As explained previously, the chronograph 1/10 second hand 14, the chronograph second hand 15 and the chronograph minute hand 16 are rotated only in the clockwise direction based on a manipulation signal inputted from the control part 23 when a user manipulates the switch A, B, the crown or the like.

Next, the control part 23 determines whether the crown 17 is in a state where the crown is positioned at a first stage or in a state where the crown is positioned at a zero stage (step ST58).

When the control part 23 determines that the crown 17 is in a state where the crown is positioned at a zero stage (step ST58, YES), the control part 23 advances the processing to the crown zero-stage processing (step ST59). On the other hand, when the control part 23 determines that the crown 17 is in a state where the crown is positioned at a first stage (step ST58, NO), the control part 23 advances the processing to the crown first-stage processing (step ST60).

That is, as described above, with the use of the electronic timepiece 200 according to this embodiment, in the demonstration of the pointer movement, the number of times of the pointer movement is counted, and the pointer can be rotated while preventing the counted number of times of the pointer movement from becoming less than "1". For example, in the electronic timepiece 200, the number of times of the pointer movement in the clockwise direction and the number of times of the pointer movement in the counterclockwise direction are counted, and the demonstration of the pointer movement is finished at a stage where the counted number of demonstration pointer movement which is obtained by subtracting the number of times of the pointer movement in the clockwise direction by which the positional displacement of the pointer can be corrected in a correction mode from the number of times of the pointer movement in the counterclockwise direction becomes "1".

Due to such an operation, in the demonstration of the pointer movement, the control part 23 can perform the demonstration of the pointer movement such that a rotational angle of the pointer in the clockwise direction from the reference position becomes smaller than a rotational angle of the pointer in the counterclockwise direction from the reference position.

Accordingly, the electronic timepiece 200 according to this embodiment can acquire advantageous effects substantially equal to the advantageous effects of the above-mentioned embodiments 1, 2.

Here, in the explanation made heretofore, the demonstration of the pointer movement is the movement in which the pointer is rotated in the counterclockwise direction and, thereafter, the pointer is rotated in the clockwise direction or the movement in which the pointer is rotated in the clockwise direction and, thereafter, the pointer is rotated in the counterclockwise direction. However, the present invention is not limited to such movements. For example, as will be explained hereinafter, the demonstration of the pointer movement may be the movement in which the rotational direction is reversed two times or more by combining the pointer movement in the counterclockwise direction and the pointer movement in the clockwise direction.

For example, in the demonstration of the pointer movement, the control part 23 firstly moves the pointer positioned at the reference position by 1 scale in the clockwise direction, reverses the rotational direction, and moves the pointer by 1 scale in the counterclockwise direction. Subsequently, the control part 23 further reverses the rotational direction and moves the pointer by 30 scales in the clockwise direction, reverses the rotational direction, and moves the pointer by 30 scales in the counterclockwise direction.

Accordingly, for example, even when a motor drive polarity of the third drive circuit 28 is brought into an attractive state in the first 1-scale pointer movement in the automatic demonstration of the pointer movement, the chronograph second hand 15 which is firstly positioned at the reference position of scale "0" is moved by 1 scale in the counterclockwise direction and, thereafter, is moved by 30 scales in the clockwise direction, and subsequently is moved by 30 scales in the counterclockwise direction. Accordingly, the chronograph second hand 15 is positioned at the scale "59" which is displaced by 1 scale from the reference position of scale "0" in the counterclockwise direction.

On the other hand, even when the motor drive polarity of the third drive circuit 28 is not brought into an attractive state in the first 1-scale pointer movement in the automatic demonstration of the pointer movement, the chronograph second hand 15 which is firstly positioned at the reference position of scale "0" is moved by 1 scale in the clockwise direction, is moved by 1 scale in the counterclockwise direction and, thereafter, is moved by 30 scales in the clockwise direction, and subsequently is moved by 30 scales in the counterclockwise direction. Accordingly, the chronograph second hand 15 is returned to the reference position of original scale "0".

In this manner, even when the pointer does not return to the original position after the automatic demonstration of the pointer movement, it is possible to return the chronograph secondhand 15 to the reference position of scale "0" by merely pushing the switch A one time. Accordingly, in correcting the positional displacement of the pointer caused by the demonstration of the pointer movement, a user can easily perform the correction manipulation within a short time.

Further, for example, in the demonstration of the pointer movement, the control part 23 firstly moves the pointer positioned at the reference position by 30 scales in the counterclockwise direction, reverses the rotational direction, and moves the pointer by 30 scales in the clockwise direction. Subsequently, the control part 23 further reverses the rotational direction and moves the pointer by 1 scale in the counterclockwise direction.

Accordingly, for example, even when a motor drive polarity of the third drive circuit 28 is brought into an attractive state in the first 1-scale pointer movement in the automatic demonstration of the pointer movement, the chronograph second hand 15 which is firstly positioned at the reference position of scale "0" is moved by 29 scales in the counterclockwise direction and, thereafter, is moved by 30 scales in the clockwise direction, and subsequently is moved by 1 scale in the counterclockwise direction. Accordingly, the chronograph second hand 15 returns to the reference position of original scale "0".

On the other hand, even when the motor drive polarity of the third drive circuit 28 is not brought into an attractive state in the first 1-scale pointer movement in the automatic demonstration of the pointer movement, the chronograph second hand 15 which is firstly positioned at the reference position of scale "0" is moved by 30 scales in the counterclockwise direction and, thereafter, is moved by 30 scales in the clockwise direction, and subsequently is moved by 1 scale in the counterclockwise direction. Accordingly, the chronograph secondhand 15 is positioned at the scale "59" which is displaced only by 1 scale from the reference position of scale "0" in the counterclockwise direction.

In this manner, even when the pointer does not return to the original position after the automatic demonstration of the pointer movement, it is possible to return the chronograph second hand 15 to the reference position of scale "0" by merely pushing the switch A one time. Accordingly, in correcting the positional displacement of the pointer caused by the demonstration of the pointer movement, a user can easily perform the correction manipulation within a short time.

The steps of operation of the electronic timepieces 10, 100, 200 can be used as a program to be executed by a computer or a computer readable recording medium as a program, wherein the above-mentioned processing is performed by making a computer system read and execute the program. Here, "computer system" includes hardware such as a CPU, various memories, an OS, and peripheral equipment.

Further, "computer system" also includes a homepage provider environment (or display environment) provided that "computer system" makes use of a WWW system.

"computer readable recording medium" means a flexible disc, an optical magnetic disc, a ROM, a rewritable nonvolatile memory such as a flash memory, a portable medium such as a CD-ROM, or a storage device such as a hard disc incorporated in a computer system.

Further, "computer readable recording medium" includes a medium which stores a program for a fixed time such as a volatile memory (for example, DRAM (Dynamic Random Access Memory) incorporated into a computer system which functions as a server or a client when the program is transmitted via a network such as the Internet or a communication circuit such as a telephone circuit.

The program may be transmitted from the computer system which stores the program in a storage device or the like via a transmission medium to another computer system using transmission waves in a transmission medium. Here, "transmission medium" which transmits the program means a medium having a function of transmitting information such as a network (communication network) like the Internet or a communication circuit (communication line) like a telephone circuit.

Further, the program may be a program which is provided for realizing some of the above-mentioned functions. Still further, the program may be a so-called differential file (differential program) which realizes the above-mentioned functions in combination with a program which is already recorded in a computer system.

What is claimed is:

1. An electronic timepiece comprising:

a pointer which is rotated in a first direction based on a manipulation signal corresponding to a manipulation from the outside; and a control part which performs a demonstration of the pointer movement in which the pointer is rotated in a second direction opposite to the first direction and the first direction, wherein the pointer is positioned at a position where a rotational angle in the first direction from a preset reference position is smaller than a rotational angle in a second direction from the reference position.

2. An electronic timepiece according to claim 1, wherein the control part, in the demonstration of the pointer movement, sets a rotational angle by which the pointer is rotated in the first direction after the pointer is rotated in the second direction from the reference position smaller than a rotational angle by which the pointer is rotated in the second direction.

3. An electronic timepiece according to claim 2, wherein the control part, in the demonstration of the pointer movement, sets the number of times that the pointer is moved in the first direction after the pointer is rotated in the second direction from the reference position smaller than the number of times that the pointer is moved in the second direction.

4. An electronic timepiece according to claim 3, wherein the control part, in the demonstration of the pointer movement, sets a rotational angle by which the pointer is rotated in the second direction after the pointer is rotated in the first direction from the reference position larger than a rotational angle by which the pointer is rotated in the first direction.

5. An electronic timepiece according to claim 4, wherein the control part, in the demonstration of the pointer movement, sets the number of times that the pointer is moved in the second direction after the pointer is rotated in the first direction from the reference position larger than the number of times that the pointer is moved in the first direction.

6. An electronic timepiece according to claim 5, wherein the control part sets the number of times that the pointer is rotated in the first direction smaller than the number of times that the pointer is rotated in the second direction.

7. An electronic timepiece according to claim 6, wherein the control part performs the demonstration of the pointer movement in which the rotational direction of the pointer is reversed two times or more by combining the rotation in the first direction and the rotation in the second direction.

8. An electronic timepiece according to claim 7, wherein the control part, in the demonstration of the pointer movement, counts a first count number which is the number of times that the pointer is rotated in the first direction and a second count number which is the number of times that the pointer is rotated in the second direction, and finishes the demonstration of the pointer movement when the number of times obtained by subtracting the first count number from the second count number is 1 or more.

9. An electronic timepiece according to claim 8, wherein the control part reverses the rotational direction of the pointer when a second manipulation signal which differs from the first manipulation signal is inputted to the control part from the outside in the demonstration of the pointer movement.

10. An electronic timepiece according to claim 1, wherein the control part stops the pointer in a rotating state when a second manipulation signal which differs from the first manipulation signal is inputted to the control part in the demonstration of the pointer movement.

11. An electronic timepiece according to claim 1, wherein the control part determines whether or not the supply of electricity from a battery is started in a state where the supply of electricity from the battery is interrupted, and starts the demonstration of the pointer movement when the control part determines that the supply of electricity from the battery is started.

12. An electronic timepiece according to claim 1, wherein the pointer is a pointer which measures a lapsed time when a stopwatch function installed in the electronic timepiece is carried out.

* * * * *